US005094555A

United States Patent [19]

Suzaki et al.

[11] Patent Number: 5,094,555

[45] Date of Patent: Mar. 10, 1992

[54] THERMAL PRINTER AND INVERTIBLE RIBBON CASSETTE THEREFOR INCLUDING A VARIABLE RIBBON BRAKING AND RIBBON DETECTION MEANS

[75] Inventors: Masafumi Suzaki; Fumio Takahagi, both of Hitachi; Katsumasa Mikami, Ibaraki; Tomoji Kitagishi; Ryooichi Kobayashi, both of Hitachi; Shigetaka Furukawa, Takahagi; Akira Sasaki, Hitachi, all of Japan

[73] Assignee: Hitachi, Ltd., Tokyo, Japan

[21] Appl. No.: 206,106

[22] Filed: Jun. 13, 1988

Related U.S. Application Data

[63] Continuation of Ser. No. 838,694, Mar. 12, 1986, abandoned.

[30] Foreign Application Priority Data

Mar. 15, 1985 [JP] Japan ..... 60-50478
Apr. 25, 1985 [JP] Japan ..... 60-87414
May 9, 1985 [JP] Japan ..... 60-98554

[51] Int. Cl.[5] ..... B41J 35/08

[52] U.S. Cl. ..... 400/234; 400/208; 400/120

[58] Field of Search ..... 400/120, 207, 208, 208.1, 400/217, 234, 240, 240.4, 249, 656, 657; 242/75, 75.2, 75.4, 75.45

[56] References Cited

U.S. PATENT DOCUMENTS 2,838,250 6/1958 Stavrakis et al. ..... 242/75.2 X
2,902,136 9/1959 Whippo ..... 400/208 X
2,963,236 12/1960 Grosser et al. ..... 242/75.45
3,356,202 12/1967 Goff, Jr. ..... 242/75 X
3,411,731 11/1968 Kelley ..... 400/208 X
3,632,052 1/1972 Read ..... 400/219.3

(List continued on next page.)

FOREIGN PATENT DOCUMENTS 0154990 9/1985 European Pat. Off. ..... 400/208
0165396 12/1985 European Pat. Off. ..... 400/234
0173144 3/1986 European Pat. Off. ..... 400/208
0029589 8/1974 Japan .
0047685 3/1982 Japan ..... 400/249
0129763 8/1982 Japan .
0140175 8/1982 Japan .
0144042 8/1983 Japan ..... 242/75
0194042 12/1983 Japan .
0190884 10/1984 Japan ..... 400/249
0224383 12/1984 Japan ..... 400/208
0015188 1/1985 Japan ..... 400/249
0018381 1/1985 Japan ..... 400/208
0019585 1/1985 Japan .
0116477 6/1985 Japan ..... 400/208
0190379 9/1985 Japan ..... 400/249

OTHER PUBLICATIONS

IBM Technical Disclosure Bulletin, "Reel Cartridge", Blanc, vol. 21, No. 10, Mar. 1979, p. 4062.
IBM Technical Disclosure Bulletin, "Reversible Ribbon Cartridge", vol. 27, No. 10A, Mar. 1985, p. 5523.

*Primary Examiner*—David A. Wiecking
*Attorney, Agent, or Firm*—Antonelli, Terry, Stout & Kraus

[57] ABSTRACT

A combination of a thermal printer and an invertible ribbon cassette has a mechanism for preventing a portion of the inked ribbon extending between a supply core and a take-up core of the ribbon cassette from shifting in the direction perpendicular to the longitudinal direction of the inked ribbon with respect to a printing head. The mechanism includes a substantially planar surface of a platen, and a printing head is urged against the planar surface of the platen through the inked ribbon portion and a sheet to which solid ink in the area on the inked ribbon portion is transferred by the printing head. The width of that area on the inked ribbon portion in the widthwise direction of the inked ribbon is at most equal to a half of the width of the inked ribbon. Alternatively, the mechanism includes a detector mechanism operative in response to the variation in diameter of the inked ribbon wound on the supply core for applying a variable back tension in the reverse direction to the tension acting on the inked ribbon portion by the take-up core.

18 Claims, 21 Drawing Sheets

U.S. PATENT DOCUMENTS

| | | | |
|---|---|---|---|
| 3,974,906 | 8/1976 | Lee et al. | 400/208 X |
| 4,013,160 | 3/1977 | Colecchi et al. | 242/75.45 X |
| 4,074,799 | 2/1978 | Hishida et al. | 400/208 |
| 4,083,445 | 4/1978 | Brauldi | 400/208 X |
| 4,115,013 | 9/1978 | Hedstrom | 400/208 X |
| 4,147,439 | 4/1979 | Colecchi | 400/208 |
| 4,264,223 | 4/1981 | Bemis et al. | 400/208 |
| 4,387,380 | 6/1983 | Asakura et al. | 400/120 |
| 4,413,920 | 11/1983 | Matthias | 400/234 |
| 4,422,592 | 12/1983 | Swope et al. | 400/234 X |
| 4,494,886 | 1/1985 | Kondo et al. | 400/249 X |
| 4,496,255 | 1/1985 | Meintrup et al. | 400/208 |
| 4,505,605 | 3/1985 | Hasegawa et al. | 400/234 |
| 4,533,266 | 8/1985 | Saito et al. | 400/234 X |
| 4,544,291 | 10/1985 | Nagata et al. | 400/234 X |
| 4,568,210 | 2/1986 | Privitera | 400/208 X |
| 4,586,056 | 4/1986 | Okamura et al. | 400/120 X |
| 4,692,774 | 9/1987 | Nagashima et al. | 400/208.1 |

THERMAL PRINTER AND INVERTIBLE RIBBON CASSETTE THEREFOR INCLUDING A VARIABLE RIBBON BRAKING AND RIBBON DETECTION MEANS

This is a continuation of application Ser. No. 838,694, filed Mar. 12, 1986, now abandoned.

BACKGROUND OF THE INVENTION

The present invention relates to a printer for use with a ribbon cassette having a rotatable supply core around which an inked ribbon is wound and a rotatable take-up core onto which the inked ribbon is taken up, for thermally transferring solid ink on the inked ribbon onto a sheet.

In a printer of the aforementioned type, the inked ribbon cannot be reused, because the ink on the inked ribbon is thermally transferred onto the sheet during the printing operation thereby resulting in increasing the overall operating cost of the printer.

In order to solve the above problem, it has been proposed to divide the ink on the inked ribbon into at least a first and a second track extending longitudinally of the ribbon in parallel to each other and to use the second track after the first track has been used. Such a proposal is disclosed in, for example, Japanese Utility Model Laid-Open No. 58-194042 and Japanese Patent Laid-Open No. 57-47685. However, in the above noted proposals, the inked ribbon, fed from the supply core to the take-up core, tends to be shifted perpendicularly in the longitudinal direction of the inked ribbon relative to a printing head facing the inked ribbon. Due to the lateral shifting of the inked ribbon, a new problem occurs in that the ink ribbon approaches an upper inner wall surface or a lower inner wall surface of a casing of the ribbon cassette as the inked ribbon is taken up onto the take-up core and, finally, the inked ribbon contacts the upper or the lower inner wall surface. The contact of the inked ribbon being taken up onto the take-up core with the upper or lower inner wall surface makes it impossible to take up the inked ribbon properly onto the take-up core. Further, in case the inked ribbon has at least two tracks, the allowance of the lateral shifting of the ribbon relative to the printing head is smaller than the case in which the central area in the width of the inked ribbon is used in the printing operation. Thus, when the inked ribbon is shifted laterally with respect to the printing head even by a small amount, it will be shifted out of the printing area on the printing head or, when the second track on the inked ribbon is used in the printing operation, the printing area on the printing head will be positioned on the first track from which the ink has already been stripped out thereby characters.

An object of the present invention is to provide a printer which makes it possible to prevent the inked ribbon from shifting perpendicularly to the longitudinal direction of the inked ribbon at the printing head where the inked ribbon faces thereagainst.

Another object of the present invention is to provide a combination of a ribbon cassette and a printer wherein the ink ribbon which has once been used in the printing operation can again be used.

In accordance with the present invention, a printer for use with a ribbon cassette is provided which includes a rotatable supply core having an inked ribbon wound therearound and a rotatable take up core for taking up the inked ribbon, for thermally transferring solid ink on the ink ribbon to a sheet, with the printer including an elongated platen extending substantially perpendicular to a direction of movement of the sheet upon a starting of a new line, and a carriage reciprocated longitudinally of the platen, with the ribbon cassette loaded on the carriage for movement therewith.

A printing head is mounted on the carriage for movement therewith for applying thermal energy for the thermal transfer of the inked ribbon, with the printing head being movable between the first position remote from the platen and a second position where a portion of the inked ribbon extending between the supply and take up cores of the ribbon cassette is urged by the printing head against the sheet on the platen to thereby thermally transfer the ink within an area of the inked ribbon portion to the sheet. An area of the ink ribbon portion has a width which is at most equal to one half of a width of the inked ribbon. The platen has a surface facing the printing head through the inked ribbon and sheet when the printing head occupies a second position, with the surface of the platen being substantially planar over an extent within which the printing head is reciprocated.

According to further features of the present invention, a ribbon cassette and printer for thermally transferring solid ink on an inked ribbon within a ribbon cassette to a sheet is provided wherein the ribbon cassette includes a rotatable supply core having an inked ribbon wound therearound and a rotatable take up core for taking up the inked ribbon. The printer includes an elongated platen which extends substantially perpendicular to a direction of movement of the sheet upon starting of a new line, and a carriage reciprocated longitudinally of the platen, with the ribbon cassette capable of being loaded on the carriage for movement therewith. A printing head is mounted on the carriage for movement therewith, with the printing head being movable between a first position remote from the platen and a second position. A portion of the linked ribbon extending between the supply and take up cores of the ribbon cassette, is urged by the printing head against the sheet on the platen to thermally transfer the ink within the area of the linked ribbon portion to the sheet. An area of the linked ribbon portion has a width being at most equal to one half of a width of the inked ribbon. A mechanism is provided for rotatably driving the take up core of the ribbon cassette to impart a taking-up tension to the linked ribbon portion. Means are mounted on either one of the carriage of the printer or the ribbon cassette and are operative in response to a change in diameter of the inked ribbon wound around the supply core for imparting a variable back tension, opposite to the take-up tension, to the inked ribbon so as to constantly satisfy the following inequality, with the back tension being variable so as to be reduced in accordance with the reduction in the diameter of the inked ribbon wound around the supply core:

$$fo/fi < \alpha,$$

where $\alpha$ is a constant, fo is a take-up tension, and fi is a variable back tension.

In accordance with further advantageous features of the present invention, a ribbon cassette for a printer is provided which includes a casing, a supply core rotatably disposed within the casing, with the supply core having an inked ribbon wound therearound. A take up core is rotatably disposed within the casing for taking up the inked ribbon with a taking up tension upon operation of the printer. Means are disposed within the casing for imparting, in response to a change in diameter of the inked ribbon wound around the supply core, a variable back tension opposite to the take up tension, to a portion of the inked ribbon extending between the supply and take up cores so as to constantly satisfy the following inequality, with the back tension being variable so as to be reduced in accordance with a reduction in the diameter of the inked ribbon wound around the supply core, $$fo/fi < \alpha,$$

where:

$\alpha$ is a constant, fo is a take up tension, and fi is a variable back tension.

According to the present invention an inked ribbon unit and a printer for thermally transferred solid ink on an inked ribbon of the inked ribbon unit to a sheet is provided wherein the inked ribbon unit includes a rotatable supply core having the inked ribbon wound thereon and a rotatable take up core for taking up the inked ribbon. The printer includes an elongated platen extending substantially perpendicular to a direction of movement of the sheet upon a starting of a new line, with movable means being adapted to be reciprocated longitudinally of the platen. A printing head is mounted on the movable means for movement therewith, with the printing head being movable between a first position remote from the platen and a second position where a portion of the inked ribbon, extending between the supply and take up cores of the inked ribbon unit, is urged by the printing head against the sheet on the platen to thermally transfer solid ink on the inked ribbon portion to the sheet. Detecting means are provided for detecting whether or not the ink exists on the inked ribbon to respectively generate a first signal when the ink exists on the inked ribbon and a second signal when the ink at least partially does not exist on the inked ribbon. Control means, operative in response to the first signal from the detecting means, control the printer so as to allow the printer to perform a printing operation, and are operative in response to the second signal from the detecting means for controlling the printer so as to prevent a printing operation. Enabling means are provided for enabling the detecting means to generate the first signal regardless of whether the ink exists on the inked ribbon.

According to the present invention, a ribbon cassette and printer for thermally transferring solid ink on an inked ribbon within the ribbon cassette to a sheet is provided wherein the ribbon cassette includes a rotatable supply core having the inked ribbon wound thereon and a rotatable take up core for taking up the inked ribbon. The printer includes an elongated platen extending substantially perpendicular to a direction of movement of a sheet upon starting a new line, and a carriage reciprocated longitudinally of the platen. The ribbon cassette is loaded on the carriage for movement therewith, and a printing head is mounted on the carriage for movement therewith. The printing head is movable between a first position remote from the platen and a second position where a portion of the inked ribbon, extending between the supply and take up cores of the ribbon cassette, is urged by the printing head against the sheet on the platen to thermally transfer the ink within the area of the inked ribbon portion to the sheet. Detecting means detect whether or not ink exists on the inked ribbon to respectively generate a first signal when the ink exists on the inked ribbon and a second signal when the ink at least partially does not exist on the inked ribbon. Control means, operative in response to the first signal from the detecting means, control the printer so as to allow the printer to perform its printing operation and, in response to the second signal from the detecting means, controls the printer so as to prevent a printing operation. Further means enable the detecting means to generate the first signal regardless of whether or not the ink exists on the inked ribbon.

DETAILED DESCRIPTION OF THE PREFERRED EMBODIMENTS

Figure 1:
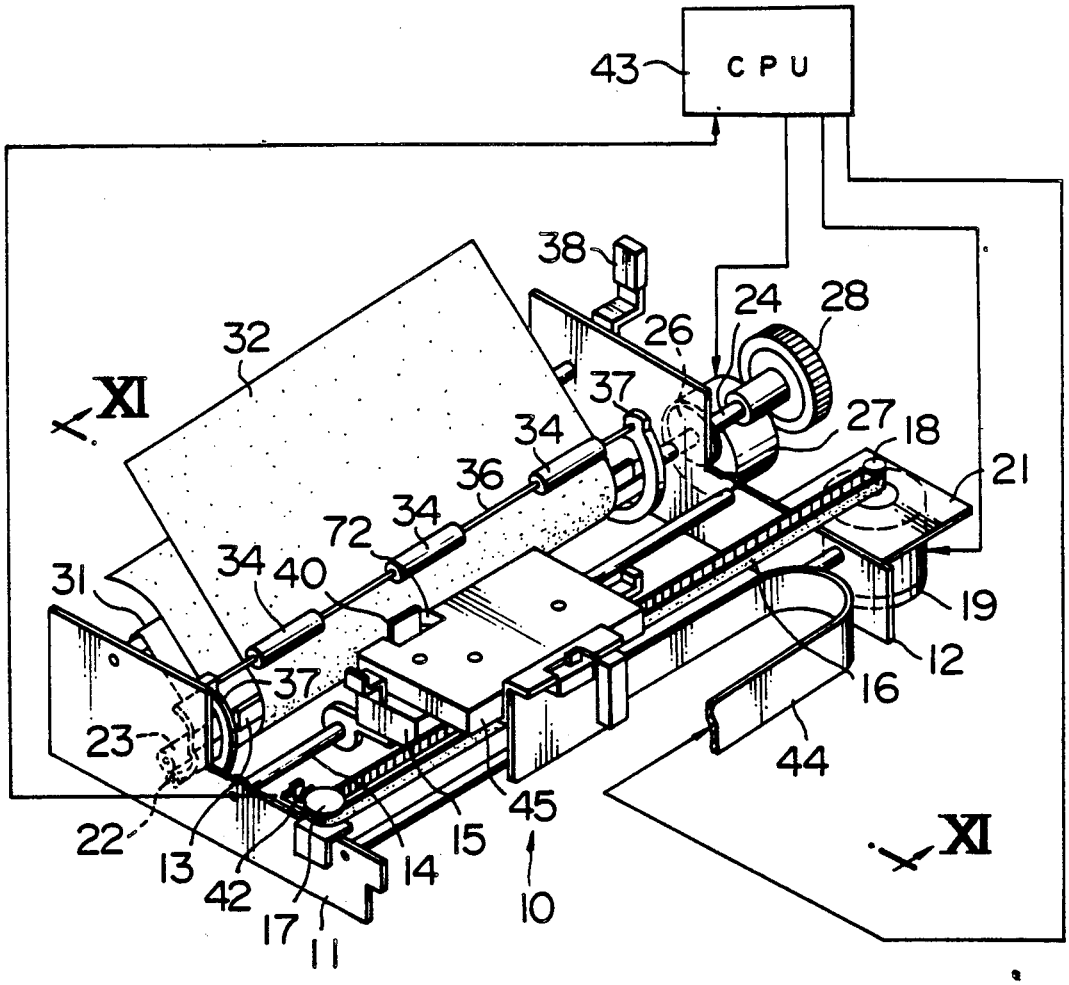
FIG. 1 is a schematic perspective view showing the entire printer according to a first embodiment of the present invention.

Referring now to the drawings wherein like reference numerals are used throughout the various views to designate like parts and, more particularly, to FIG. 1, according to this figure, a printer 10 includes a pair of spaced opposed side wall members 11, 12, with an elongated platen 13 extending between the pair of side wall members 11, 12 and mounted thereon. A shaft 14 has opposite ends thereof respectively fixedly supported by the pair of side wall members 11, 12 and has an axis extending substantially in parallel to the platen 13. A carriage 15 is shiftably supported on the shaft 14 so as to be moved therealong.

The carriage 15 is fixedly connected to a timing belt 16, with the timing belt 16 being trained around a roller 17 rotatably mounted on the side wall member 11, and an output shaft 18 of a motor 19 supported on a bracket 21 which is secured to the side wall member 12. When the motor 19 is energized, the carriage 15 is reciprocably moved along the shaft 14 by the timing belt 16.

A pair of rollers formed by a pinch roller 22 and a feed roller 23 are rotatably supported by the side wall members 11 and 12. The feed roller 23 has a protruding end 24 extending through and beyond the side wall member 12, with a gear 26 being mounted on the protruding end 24 of the feed roller 23 for rotation therewith. A line feed motor 27, supported by the side wall member 12, has an output shaft (not shown) meshing with the gear 26. A knob 28 is mounted on the protruding end 24 of the feed roller 23 thereby permitting the same to be rotated manually. A guide 31, supported by the side wall members 11, 12, serves to direct a leading edge of a sheet 32 toward the nip between the rollers 22 and 23. The sheet 32 may be of any material such as paper, plastic, etc., insofar as ink can be transferred thereon. When the line feed motor 27 is energized, the feed roller 23 is rotated to feed the sheet 32 onto the platen 13. The sheet 32 is pressed against the platen 13 by a plurality of press rollers 34 rotatably supported on a rod 36, with the rod 36 being swingably connected to the side wall members 11, 12 through a pair of levers 37. A release lever 38 is connected to one of the levers 37 to move the rod 36 between a first position at which the press rollers 34 press the sheet 32 against the platen 13 and a second position at which the press rollers 34 are held spaced apart from the platen 13.

A printing head 40 having a heat generating resistance element 41 (FIG. 11) is mounted on the carriage 15 so as to be moved therewith thereby permitting the printing head 40 to move toward and away from the platen 13. A sensor 42 for detecting a home position of the carriage 15 is mounted on the side wall member 11 The carriage 15 is connected to a central processing unit (CPU) 43 of the control device through a flexible cable 44. In a similar manner, the motor 19, the motor 27 and the sensor 42 are also connected to CPU 43.

Figure 2:
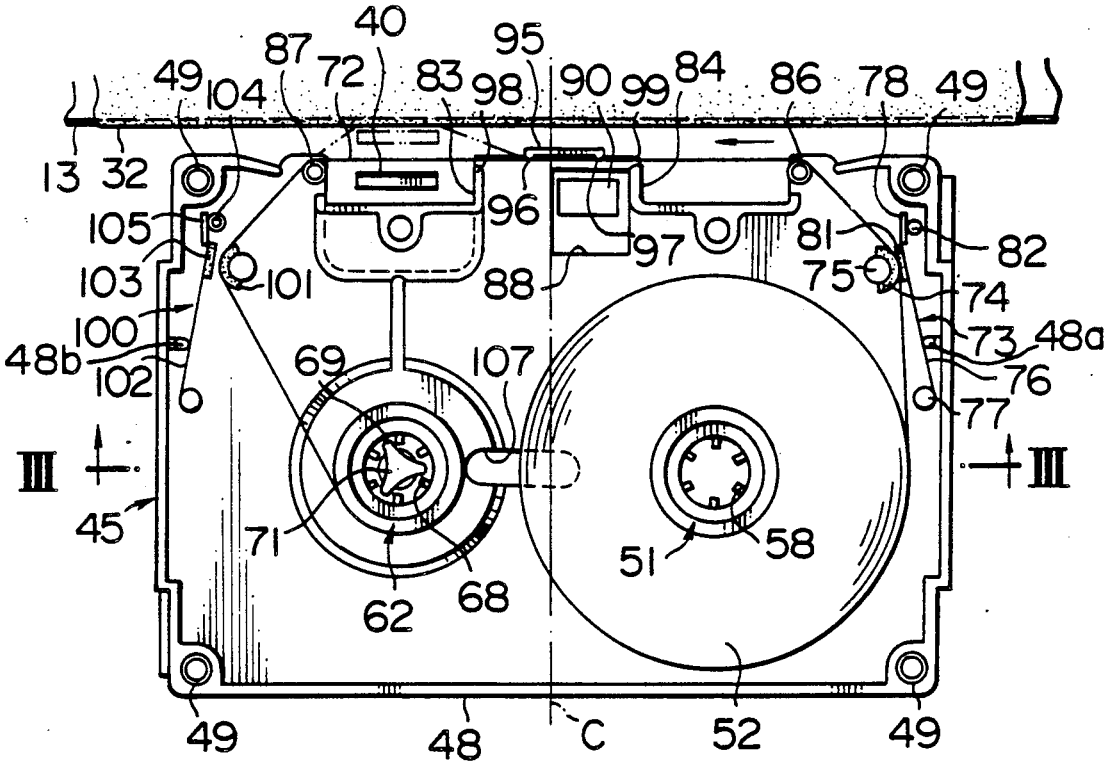
FIG. 2 is a fragmentary plan view showing a ribbon cassette loaded on a carriage of the printer, with a first casing half of the ribbon cassette being removed.
Figure 3:
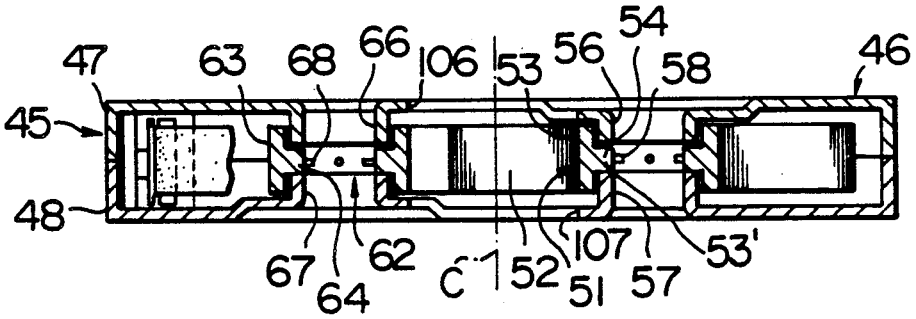
FIG. 3 is a sectional view taken along the line III—III in FIG. 2.

A ribbon cassette generally designated by the reference number 45 can be loaded on the carriage 15. As shown in FIGS. 2 and 3, the ribbon cassette 45 includes a casing 46 constituted by a first casing half 47 and a second casing half 48, with the first casing half 47 and the second casing half 48 being joined together by fasteners such as, for example, screws (not shown) threadably accommodated in threaded holes 49. A supply core generally designated by the reference numeral 51 has an inked ribbon 52 having thermally meltable solid ink applied thereon wound thereon, with the supply core 51 having a cylindrical body 53 and a circular rib 54 projecting radially inwardly from and inner peripheral surface 53' of the cylindrical body 53 as shown in FIG. 3. The circular rib 54 is loosely fitted between a circular boss 56 formed in the first casing half 47 and a circular boss 57 formed in the second casing half 48 thereby permitting the supply core 51 to be rotatably supported by the casing 46. The circular rib 54 is provided with a plurality of projections 58 projecting radially inwardly therefrom. In a similar manner, a take-up core 62 for taking up the inked ribbon 52 includes a cylindrical body 63 and a circular rib 64. The circular rib 64 is loosely fitted between circular bosses 66, 67 formed in the first and second casing halves 47, 48, respectively, thereby permitting the take-up core 62 to be rotatably supported by the casing 46. The circular rib 64 includes projections 68 similar to the projections 58 provided on the circular rib 54 and the projections 68 engage with projections 69 on a rotary driving shaft 71 provided in the carriage 15.

Figure 4:
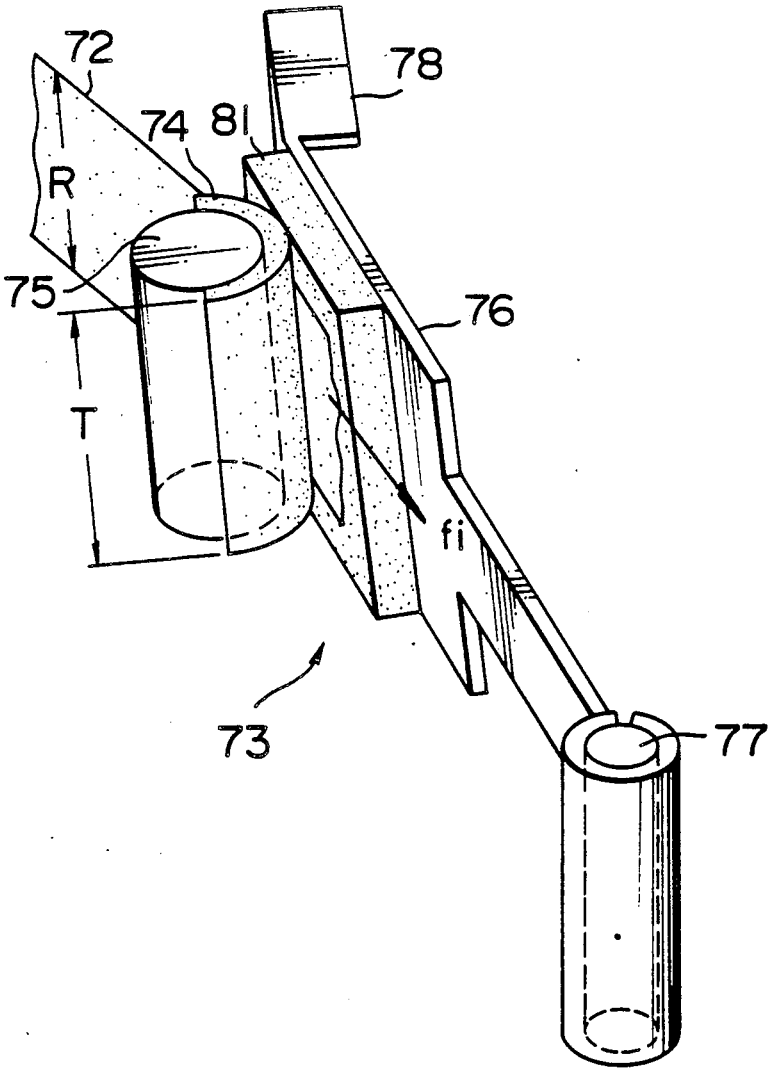
FIG. 4 is a perspective view in an enlarged scale showing the back tension applying mechanism shown in FIG. 2.

A portion 72 of the inked ribbon 52 extending between the supply core 51 and the take-up core 62 passes through a back tension applying mechanism generally designated by the reference numeral 73, with the back tension applying mechanism 73 including a friction material 74 made of felt which is adhesively secured to a post 75 integrally formed in the second casing half 48 as shown in FIG. 4. A plate spring 76 includes an end rotatably supported on a post 77 which is integrally formed in the second casing half 48, with the other end of the leaf spring 76 being provided with an engaging portion 78.

A friction material 81 of felt is adhesively secured to a portion of the leaf spring 76 between respective ends thereof. A projection 48*a*, integrally formed in the second casing half 48, abuts against a rear surface of the leaf spring 76 opposite to the side on which the friction material 81 is mounted. Due to the abutment of the projection 48*a* against the leaf spring 76, the friction material 81 on the leaf spring 76 is resiliently urged against the friction material 74 on the post 75. When the ribbon cassette 45 is loaded on the carriage 15 as shown in FIG. 2, and also when unloaded from the carriage 15, the friction material 81 is resiliently urged against the friction material 74, thereby applying a predetermined constant back tension fi to the portion 72 of the inked ribbon 52 passing through between the friction materials 81 and 74.

Referring again to FIGS. 2 and 3, the casing 46 of the ribbon cassette 45 is formed with a pair of symmetrically positioned notches 83, 84 symmetrically positioned with respect to a center line C shown by the dot-and-dash line in FIGS. 2 and 3, with the center line C being at an equal distance from both the rotary axis of the supply core 51 and the rotary axis of the take-up core 62. When the ribbon cassette 45 is loaded on the carriage 15 as shown in FIG. 2, the thermally sensitive head 40 on the carriage 15 is positioned in one of the pair of notches 83, 84 and the portion 72 of the inked ribbon 52 extending between a pair of guides 86, 87 provided in the second casing half 48 of the ribbon cassette 45 is located between the platen 13 and the thermally sensitive head 40.

Figure 5:
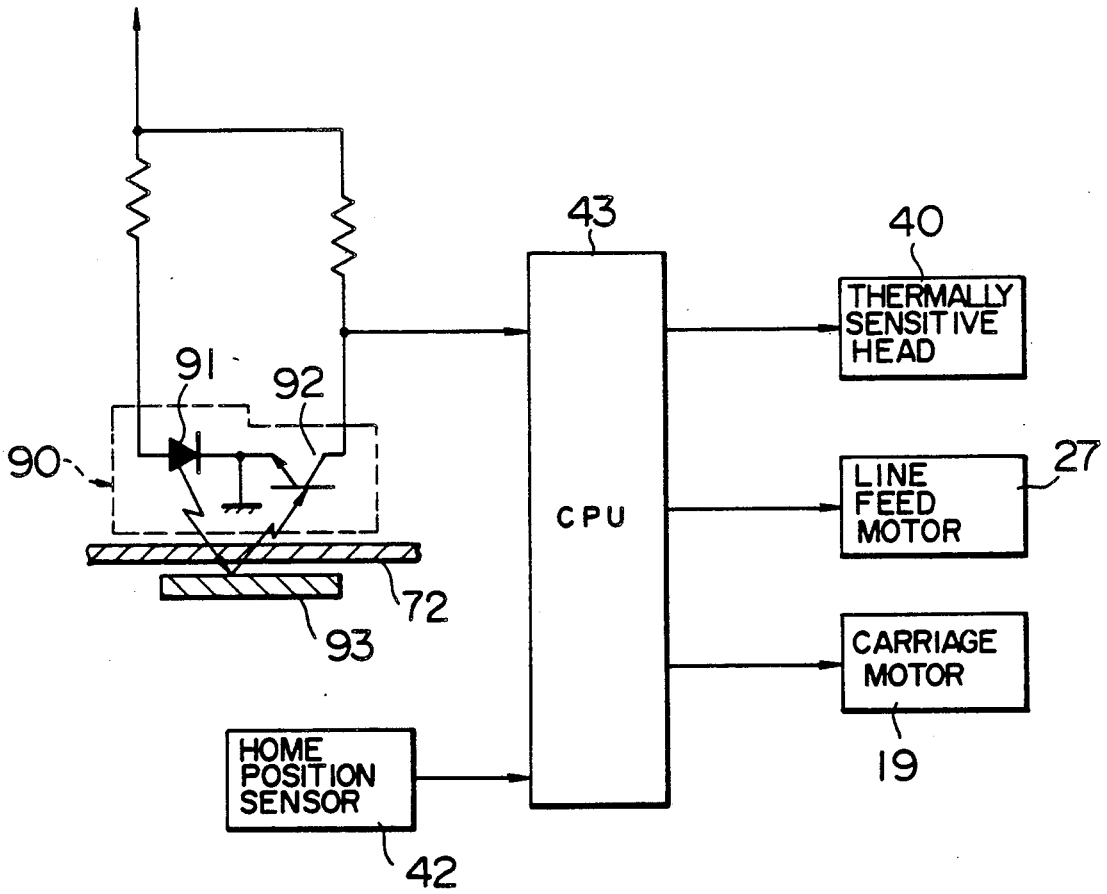
FIG. 5 is a block diagram showing a circuit associated with a ribbon sensor.

Each of the first and second casing halves 47, 48 of the ribbon cassette 45 is formed with an opening 88, and the openings 88 formed in the respective first and second halves 47, 48 are symmetrically positioned with respect to the center line C. When the ribbon cassette 45 is loaded on the carriage 15, a ribbon sensor 90 on the carriage 15 is introduced into the ribbon cassette 45 through the opening 88, and the portion 72 of the inked ribbon 52 is located between the ribbon sensor 90 and the platen 13. As shown in FIG. 5, the ribbon sensor 90 includes a light emitting diode 91 for projecting light onto the portion 72 of the inked ribbon 52 extending between the supply core 51 and the take-up core 62 of the ribbon cassette 45 when the ribbon cassette 45 is loaded on the carriage 15 of the printer 10 as well as a phototransistor 92 for receiving light from the diode 91 after reflected by a reflecting plate 93 on the carriage 15. The ribbon sensor 90 is adapted to issue a first signal when the portion 72 of the inked ribbon 52 is present between the ribbon sensor 90 and the platen 13, while it issues a second signal when the portion 72 is not present between the ribbon sensor 90 and the platen 13, and the signal thus issued is supplied to CPU 43 shown in FIG. 1 thereby permitting the second signal to be issued when the portion 72 of the inked ribbon 52 deviates from the path of the thermally sensitive head 40 for some reason or when the ribbon cassette 45 is not loaded on the carriage 15 at the start of operation of the printer 10 to render the printer 10 inoperative. Further, the ribbon sensor 90 detects the terminal end of the inked ribbon 52 wound around the supply core 51 and supplies the second signal to CPU 43 to inform the operator of the fact that the inked ribbon 52 on the supply core 51 has been depleted.

Further, when the feeding of the ribbon 52 commences and the thermally sensitive head 40 moves toward the platen 13, the supply core 51 tends to overrun due to the inertia thereof because the thermally sensitive head 40 pulls out the inked ribbon 52 at a high speed, thereby feeding out the length of the inked ribbon 52 from the supply core 51 greater than the length in the steady state of feeding of the inked ribbon 52. Therefore, the inked ribbon 52 tends to be slackened because the amount of the inked ribbon 52 taken up by the take-up core 62 does not corresponded to that fed out of the supply core 51. Such a slackening of the inked ribbon 52 occurs between the supply core 51 and the back tension applying mechanism 73. Thus, the ribbon sensor 90 is arranged at a location where no slackening of the inked ribbon 52 occurs, i.e. at a position between the back tension applying mechanism 73 and the thermally sensitive head 40 within the path of feeding of the inked ribbon 52.

A guide 95, integrally formed in the second casing half 48 of the ribbon cassette 45 and extending between the first and second casing halves 47, 48, is provided with a pair of projections 96, 97 which are positioned substantially symmetrical to each other with respect to the center line C. The pair of projections 96, 97 guide the portion 72 of the inked ribbon 52 with a minimum contact resistance so as to permit the portion 72 of the inked ribbon 52 to run along the predetermined path. A pair of guides 98, 99, integrally formed on the second casing half 48 at either side of the opening 88, serve to guide the inked ribbon 52 when the feeding of the inked ribbon 52 is commenced or stopped and when the thermally sensitive head 40 is moved in the direction toward the platen 13 and in a direction away from the platen 13 so that the portion 72 of the inked ribbon 52 is exactly located in front of the ribbon sensor 90 thereby preventing a false signal from the ribbon sensor 90 due to the slackening of the inked ribbon 52.

The ribbon cassette 45 shown in FIGS. 1 to 3 can be used again in inverted position in like manner as the ribbon cassette disclosed in, for example, Japanese Patent Laid-Open No. 57-47685. Specifically, the inked ribbon 52 in the ribbon cassette 45 is divided into first and second tracks A and B, each having a width of R/2 (FIG. 7) and tracks M,N on ribbon 52 (FIG. 12) and on ribbon 304 (FIG. 17) extending longitudinally of the inked ribbon 52 in parallel to each other. In the loaded state in FIG. 2, when the inked ribbon 52 is fed from the supply core 51 to the take-up core 62, a printing operation is carried out by using the first track M on the inked ribbon 52. After the inked ribbon 52 from the supply core 51 is completely taken up onto the take-up core 62, the ribbon cassette 45 is unloaded from the carriage 15. The unloaded ribbon cassette 45 is inverted and is again loaded on the carriage 15 and the take-up core 62 then acts as a supply core, while the supply core 51 acts as a take-up core. When the inked ribbon 52 from the take up core 62 is taken up onto the supply core 51, the second track B on the inked ribbon 52 is used to carry out the printing process.

Since the ribbon cassette 45 is reusable in the inverted position, it is formed in a configuration substantially in symmetry with respect to the center line C. Specifically, the supply core 51 and the take-up core 62 are formed in the same configuration and each of the supply and take up cores 51, 62 is placed between the corresponding bosses 56, 66 on the first casing half 47 and the corresponding bosses 57, 67 on the second casing half 48, respectively, with a minimum gap therebetween to thereby prevent the position of each of the supply and take up cores 51, 62 from being shifted when the ribbon cassette 45 is inverted In order to apply a predetermined constant back tension fi to the portion 72 of the inked ribbon 52 when the ribbon cassette 45 is inverted and the take-up core 62 acts as a supply core, a back tension applying mechanism 100 is arranged adjacent the take-up core 62. The back tension applying mechanism 100 is similar in construction to the back tension applying mechanism 73 arranged adjacent the supply core 51, and includes a friction material 101, a leaf spring 102 and a friction material 103 corresponding to the friction material 74, the leaf spring 76 and the friction material 81 of the back tensional force applying mechanism 73, respectively. Further, a projection **48*b* integrally formed on the second casing half 48 abuts against the rear surface of the leaf spring 102 opposite to the side thereof on which the friction material 103 is mounted. Due to the abutment of the projection 48*b* against the leaf spring 103, a pressing force is applied to the leaf spring 102 which tends to urge the friction material 103 to the friction material 101. When the ribbon cassette 45 is used under the condition shown in FIG. 2, a pin 104 on the carriage 15 engages an engaging portion 105 of the leaf spring 102 to maintain the friction material 103 at a position spaced apart from the friction material 101. When the ribbon cassette 45 is loaded on the carriage 15 with the cassette 45 being inverted so that the take-up core 62 acts as the supply core, the engaging portion 105 of the leaf spring 102 does not engage with any pin, because no pin is provided at the right side of the carriage 15 corresponding to the pin 104 provided at the left side thereof. Therefore, the friction material 103 of the leaf spring 102 is resiliently urged against the friction material 101. Thus, the friction materials 101, 103 cooperate with each other to apply the predetermined constant back tension to the portion 72 of the inked ribbon 52 passing through therebetween. When the ribbon cassette 45 is loaded on the carriage 15 the engaging portion 78 on the leaf spring 76 of the back tension applying mechanism 73, located adjacent the core 51, is engaged with the pin 104 on the carriage 15 passing through a hole 82 formed in the second casing half 48 of the ribbon cassette 45 to move the friction material 81 from the friction material 74**.

As shown in FIG. 3, a window 106, formed in the first casing half 47, serves to inform the operator of the amount of the inked ribbon 52 left on the supply core 51. A window 107 formed in the second casing half 48 serves to inform the operator of the amount of the inked ribbon 52 left on the take-up core 62 then acting as the supply core when the ribbon cassette 45 is loaded on the carriage 15 with the ribbon cassette 45 being inverted.

In operation of the printer 10 shown in FIG. 1, the take-up core 62 takes up the inked ribbon 52 thereon and the thermally sensitive head 40 is moved toward the platen 13 to urge the portion 72 of the inked ribbon 52 against the sheet 32 on the platen 13 thereby thermally transferring ink on the inked ribbon 52 onto the sheet 32 only when the carriage 15 is moved toward the side wall member 12. During the time the carriage 15 is moved toward the side wall member 11, the take-up core 62 does not take up the inked ribbon 52 and the thermally sensitive head 40 is maintained at a position spaced apart from the platen 13.

Experiments have been conducted to determine the reason why the portion 72 of the inked ribbon 52 is shifted in the direction perpendicular to the longitudinal direction of the inked ribbon 52 relative to the thermally sensitive head 40. As to the results of the experiments, an explanation will be given below with reference to FIGS. 6 to 10.

Figure 6:
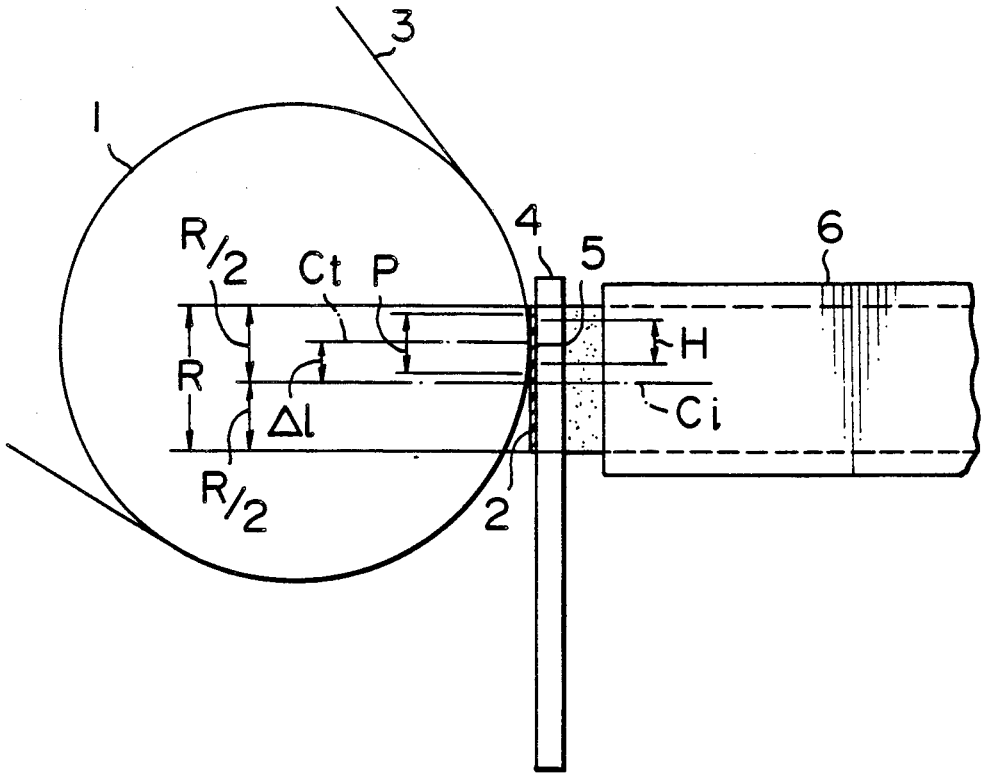
FIG. 6 PRIOR ART
FIG. 6 is a schematic fragmentary side view of a prior art printer having a rubber platen of a circular crosssection illustrating a positional relationship of the platen, inked ribbon, sheet and thermally sensitive head during experimental testing.
Figure 7:
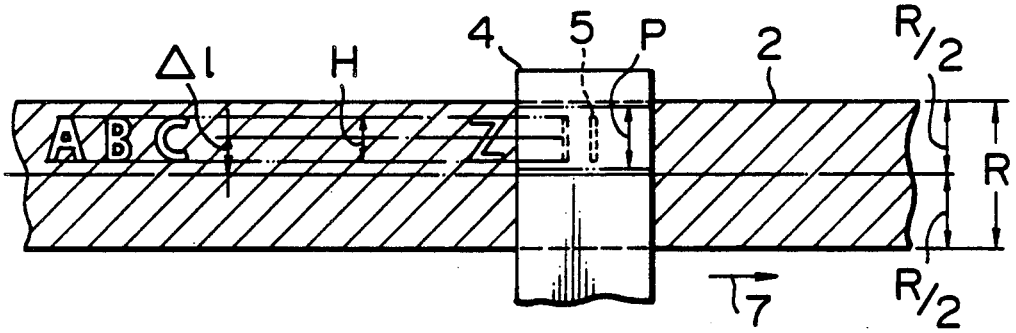
FIG. 7 PRIOR ART
FIG. 7 is an illustrative view when a thermally sensitive head shown in FIG. 6 is viewed from a rear surface thereof.

As shown in FIG. 6, thermally sensitive head 4 is pressed against the platen 1 with the sheet 3 and the inked ribbon 2 being interposed therebetween so as to apply a substantially horizontal force against the platen 1. Thus, the pressing force of the head 4 against the platen 1, the hardness of the rubber material forming the outer diameter portion of the platen 1 and the width of the head 4 are generally, so set that a width P of the pressed area formed on the surface of the platen 1 is slightly larger than a width H of an area of the heat generating resistance element 5. The inked ribbon 2 has a width R enabling the printing to be carried out by the use of one of the divided two upper and lower tracks on the inked ribbon 2, each having a width R/2. In FIGS. 6 and 7, an example is shown in which only the upper half track of the inked ribbon 2 is utilized to transfer the ink on the upper half track to the sheet 3. After the printing operation using the upper half track of the inked ribbon 2, the ribbon cassette 6 is inverted in its position and loaded on a carriage such as, for example, carriage 15 in FIG. 1, to transfer ink on the remaining half track (the track not yet used up) to the sheet 3 by using the remaining half track. Thus, the center Ci of the width of the inked ribbon 2 and the center Ct of the width of the area of the heat generating resistance element 5 is offset by the distance Δl from each other as shown in FIG. 6.

As shown in FIG. 7, the thermally sensitive head 4 transfers the ink to the sheet 3 by using the upper half track of the inked ribbon 2 while the thermally sensitive head 4 is moving in a direction indicated by the arrow 7. In FIG. 7, a shaded area represents an area of the ink ribbon 2 which is unused, while a white blank area represents a portion of the inked ribbon 2 from which the ink has been stripped off after a transfer of the ink. The distribution of tension acting on the inked ribbon 2 is clearly illustrated in FIG. 8.

The thermally sensitive head 4 presses the hatched area of the upper half track of the inked ribbon 2 onto the platen 1 Under these conditions, the taking-up tension To acts on the portion of the inked ribbon 2 extending between the supply core such as, for example, supply core 51 (FIG. 2) and the take-up core 8 in the ribbon cassette 6 in the direction indicated by the arrow A by the take-up core 8. The back tension Ti acts on the ribbon portion in the direction opposite to the tension To in order to insure the stable feeding of the inked ribbon 2 by the back tension applying mechanism 9. While the tension forces To and Ti tend to act uniformly in equal distribution over the entire width R of the inked ribbon 2, the distribution of the tension of the inked ribbon 2 is nonuniform as shown by the arrows B in FIG. 8 because the pressed area of the inked ribbon 2 by the thermally sensitive head 4 is offset in the upper side, so that the tension force acting on the lower side of the inked ribbon 2 is greater than the tension acting on the upper side thereof.

Figure 8:
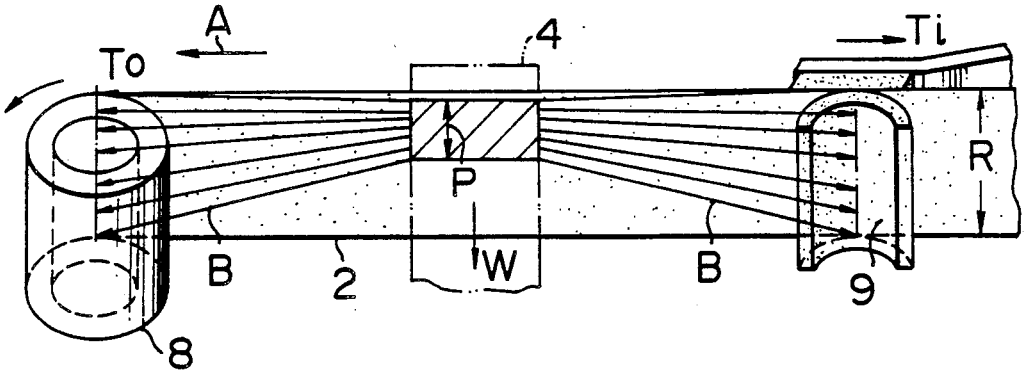
FIG. 8 PRIOR ART
FIG. 8 is a schematic view illustrating the results of experiments conducted on the printer shown in FIG. 6.
Figure 9:
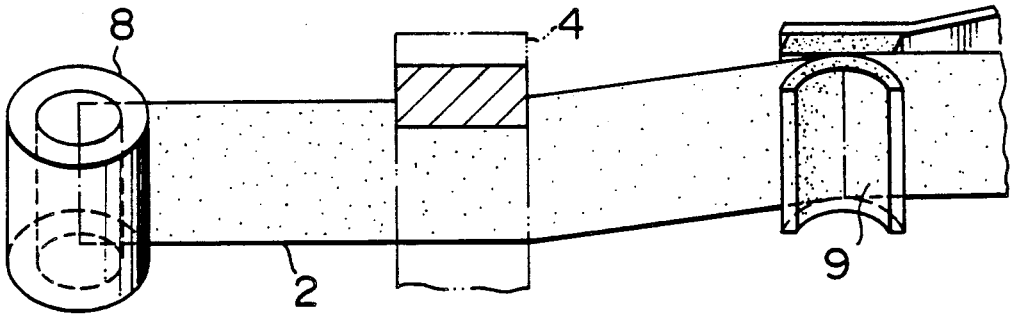
FIG. 9 PRIOR ART
FIG. 9 is a schematic view illustrating the state in which the conventional inked ribbon is shifted downwardly with respect to a thermally sensitive head.
Figure 10:
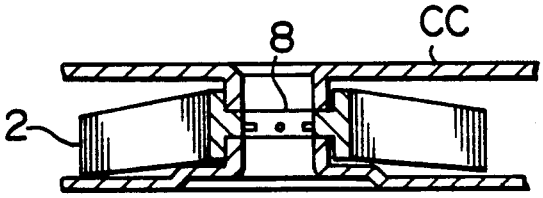
FIG. 10 PRIOR ART
FIG. 10 is a fragmentary sectional view of the ribbon cassette showing the irregularly taken-up inked ribbon resulting from the downward shifting of the inked ribbon shown in FIG. 9.

In other words, a force W is generated at the position of the thermally sensitive head 4 which tends to shift the inked ribbon 2 toward the lower side. As a result, the inked ribbon 2 is shifted downwardly at the thermally sensitive head 4 as shown in FIG. 8. Since the inked ribbon 2 is generally made of a very thin base film of about 4–8 micrometers, the inked ribbon 2 itself has substantially no rigidity. Thus, the inked ribbon 2, which has once been shifted to an incorrect position at the thermally sensitive head 4, has no ability in itself to correct its position to the proper position and, therefore, it is taken up onto the take-up core 8 by being shifted toward the lower side As described above, when the inked ribbon 2 is taken up onto the take-up core 8 in a downwardly shifted condition the inked ribbon 2 taken up onto the take-up core 8 assumes an irregularly wound form as shown in FIG. 10, so that the ribbon 2 contacts the inner wall of casing CC in which it is received resulting in in rendering a taking-up of the inked ribbon 2 impossible. The above-described example explains the phenomenon of shifting down of the inked ribbon 2 occurring at the thermally sensitive head 4 in case the upper half track of the inked ribbon 2 is used in the printing. To the contrary, however, in case the lower half track of the inked ribbon 2 is used in the printing, a phenomenon of shifting-up of the inked ribbon 2 will take place, thereby resulting naturally in a similar difficulty as described above. The phenomena of shifting-up and down of the inked ribbon 2 further cause another difficulty different from the incapability of the taking-up of the inked ribbon 2 as described below.

In case the printing is carried out by using one of at least two tracks into which the inked ribbon 2 is divided, allowance for the amount of shifting-up or -down of the position of the inked ribbon 2 is smaller than the allowance in the case in which the central area of the width R of the inked ribbon 2 is used in the printing. Therefore, when the shifting-up and -down of the inked ribbon 2 occurs at the thermally sensitive head 4, fatal defects will result such as the deviation of the inked ribbon 2 out of the path of the heat generating resistance element 5 on the thermally sensitive head 4, or failure of printing characters due to positioning of the track from which ink has been removed by a previous printing operation at the heat generating resistance element 5. As described above, it is an indispensable requirement to prevent the shifting-up or -down of the inked ribbon 2 at the thermally sensitive head 4 in order to embody the construction in which the printing is carried out using one of at least two tracks into which the inked ribbon 2 is divided, for the purposes of reduction in the operating cost.

The occurrence of the shifting-up or -down of the inked ribbon 2 when printing is carried out by using one of at least two tracks into which the inked ribbon 2 is divided is due to the fact that the thermally sensitive head 4 presses the inked ribbon 2 against the platen 1 only at the area on one side of the inked ribbon 2 rather than the central area thereof. Therefore, the shifting-up or -down of the inked ribbon 2 can be prevented if the thermally sensitive head 4 presses the inked ribbon 2 over substantially the same width as the width R of the inked ribbon 2. However, in case the existing platen 1 of circular cross-section mainly in use at present is used, more than twice of the width of the planar area on the platen 1 formed when the platen 1 is pressed by the thermally sensitive head 4 will be required in comparison with the heretofore used width, and the pressing force of the thermally sensitive head 4 and the diameter of the platen 1 and the like must be increased thereby resulting in disadvantages in the construction of the printer 10.

Figure 11:
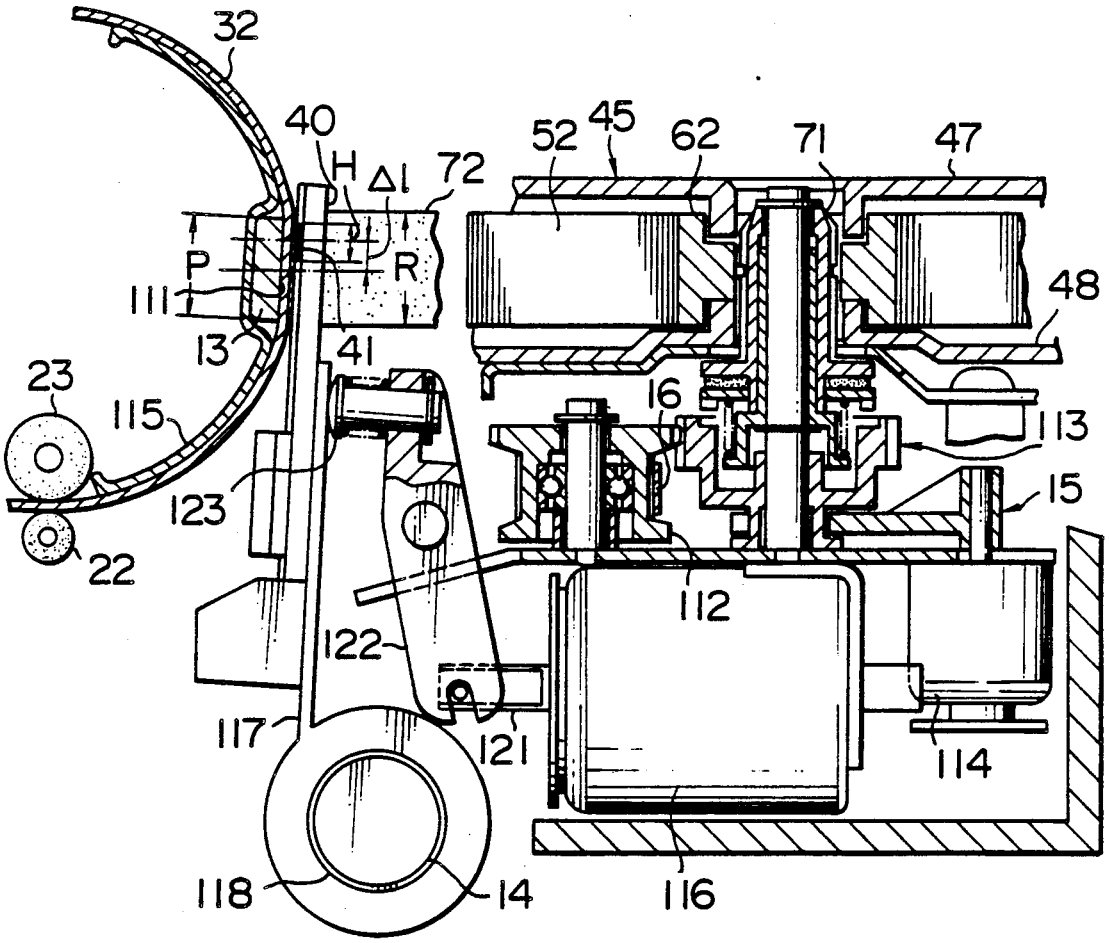
FIG. 11 is a sectional view taken along line XI—XI in FIG. 1.
Figure 12:
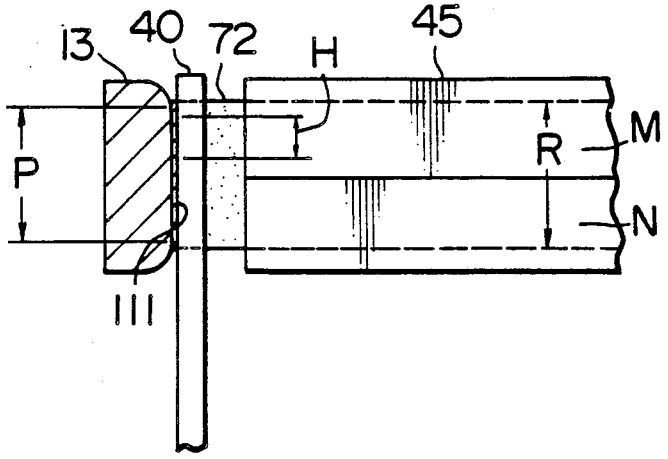
FIG. 12 is a fragmentary side view partly in cross-section showing the relationship between the platen, the inked ribbon and the thermally sensitive head shown in FIG. 11.
Figure 13:
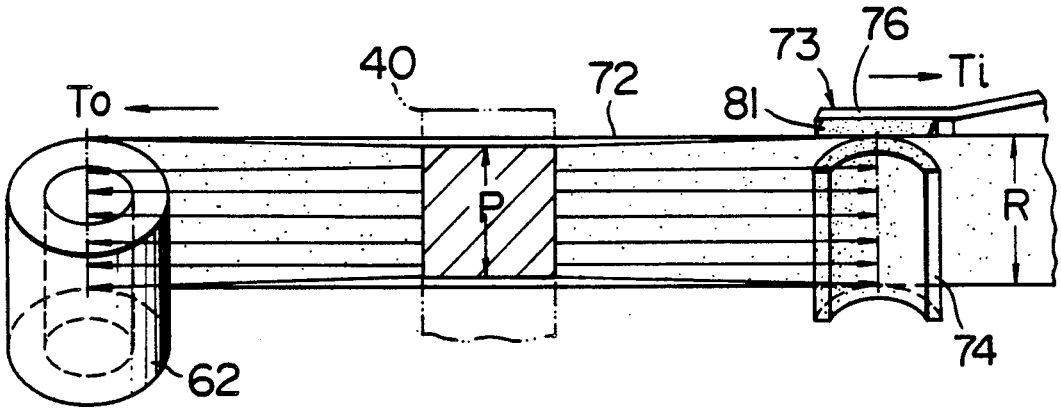
FIG. 13 is a view showing the tension acting on the inked ribbon shown in FIG. 12.

Therefore, the first embodiment of the present invention does not use a platen of circular cross section but it is constructed from the beginning by the platen 13 having a planar surface 111 of substantially the same width P as the width R of the ribbon 52 as shown in FIGS. 11 and 12. By constructing the platen 13 as described above, the distribution of the tension force acting on the surface of the portion 72 of the inked ribbon 52 is made the same value at the upper side and the lower side of the inked ribbon 52 without adopting measures such as those increasing the pressing force of the thermally sensitive head 40 as shown in FIG. 13 whereby the shifting-up or -down of the ribbon 52 will not occur.

As shown in FIG. 11, according to the present invention, the thermally sensitive head 40 is the platen 13 and the inked ribbon 52. A ribbon cassette 45, reusable in the inverted position, is loaded on the carriage 15 so that the take-up core 62 of the ribbon 52 received in the cassette 45 is engaged by the take-up shaft 71 provided on the carriage 15. The transmission of the rotating force to the ribbon take-up shaft 71 is effected by a traversing movement of the carriage 15 through the timing belt 16, a pulley gear 112 engaging therewith, and a take-up power transmitting and cut-off mechanism 113 engaging with the pulley gear 112. A solenoid 114 actuates and deactuates the ribbon take-up power transmitting and cut-off mechanism 113 in dependence upon the time required for taking-up of the ribbon 52 and the time when it is not required to take-up the ribbon 52.

The platen 13 is supported by a platen holder 115 and the feed roller 23 is arranged at the rear side of the platen holder 115. The sheet 32 is fed by urging the pinch roller 22 against the feed roller 23.

On the other hand, the pressing operation of the thermally sensitive head 40 against the platen 13 is caused by a solenoid 116 for pressing the thermally sensitive head 40. In other words, a head supporting plate 117 is angularly tiltably supported on the shaft 14 with the outer periphery of a bearing 118 connected to the carriage 15 and supported on the shaft 14 serving as a guide. The shaft 14 supports the entire carriage 15 and is capable of traversing the carriage 15 in parallel to the platen 13. The thermally sensitive head 40 is mounted on the head supporting plate 117. The pressing operation of the thermally sensitive head 40 against the platen 13 is effected by the attraction of the plunger 121 by the solenoid 116 which causes a solenoid lever 122 engaging with the plunger 121 to be tilted to urge the head 40 against the platen 13 by a head pressing pin 123 through the head supporting plate 117.

The pressing force of the head 40, the width of the platen 13, the hardness of the rubber of the platen 13 are such that the width P of the planar surface 111 formed on the surface of the platen 13, when the thermally sensitive head 40 is urged against the platen 13, has the relationship with respect to the width H of the heat generating resistance element 41 such that $P>nH$ ($n=1, 2, 3 \ldots$) where n designates the number of tracks for printing on the ribbon 52, with $n=2$ indicating the upper and lower tracks for printing. The position at which the heat generating resistance element 41 is mounted on the thermally sensitive head 40 is such that, in the case of the upper and lower tracks for printing, the mounting position is located at the upper or the lower side from the center of the width P of the planar surface 111 on the platen 13.

The positional relationship between the inked ribbon 52 and the platen 13 is such that their respective centers coincide substantially with other. The width R of the inked ribbon 52 is $R>P>nH$ so as to enable the printing by using one of the upper and lower tracks M and N, respectively on the ribbon 52 for printing, and the center of the width R of the ribbon 52 is offset from the center of the width of the heat generating resistance element 41 by a distance $\Delta l$ so that the printing is effected by using the upper track or the lower track on the ribbon 52. When constructed as described above, the distribution of the tension force acting on the portion 72 of the ribbon 52 is uniform in the upper track and the lower track of the inked ribbon 52 thereby not permitting a shifting-up or -down of the portion 72 of the ribbon 52 at the thermally sensitive head 40.

Further, the width R of the ribbon 52 and the width P of the planar surface 111 on the platen 13 are preferably substantially equal to each other, but it is preferred to make $R>P$ as described above to prevent the contamination of the sheet 32 due to the edges of the ribbon 52, and $R \simeq P+(1-5)$ mm is preferred.

As shown in FIG. 4, the width T of the friction materials 74, 78, 101 and 103 is greater than the width R of the ribbon 52. With such arrangement, the shifting in position of the ribbon 52 at the back tension applying mechanism 73 and 100 can be prevented, even though the ribbon 52 tends to be shifted upwardly or downwardly with respect to the head 40, due to the fact that the friction materials 74, 81 and 101, 103 are brought into contact with each other at the both edges of the ribbon friction materials 74, 81 and 101 and 103 to generate the resisting force against the shifting in position of the ribbon 52.

With the above-described arrangement, in a printing operation using one of two or more tracks on the ribbon 52 for printing, the shifting-up or -down of the ribbon 52 can be prevented, not only enabling a preventing of an incapability of taking-up of the ribbon 52 from occurring but also enabling a preventing of a failure of printing characters due to the shifting-up or -down of the ribbon 52.

According to the present invention, since the shifting-up pr -down of the ribbon 52 at the thermally sensitive head 40 is prevented in the case where the center of the width R of the ribbon 52 is offset from the center of the width of the heat generating resistor 41 as in the case of the printing utilizing at least two tracks on the ribbon 52, a number of advantages are achieved.

More particularly, since upper and lower tracks or more tracks are provided on a single ribbon 52, the life of the inked ribbon 52 is remarkably prolonged to permit the operating cost of the ribbon 52 to be greatly reduced thereby affording maximum merits to the user of the printer 10.

Furthermore, the service life of the ribbon 52 can be greatly increased with the construction of a printer substantially similar to that of the prior art printer using only one track on the ribbon 52.

Moreover, a width allowance of the ribbon 52 can be made small for a ribbon 52 having a plurality of tracks, and still the failure of printing characters can be prevented.

Additionally, since the regular form of the wound ribbon 52 taken-up onto the take up core 8 is achieved, the load for taking up the ribbon 52 is reduced and the incapability of taking-up of the ribbon 52 can be prevented, while the tension for taking-up the ribbon 52 can be set small thereby permitting the carriage 15 per se to be made compact.

Figure 14:
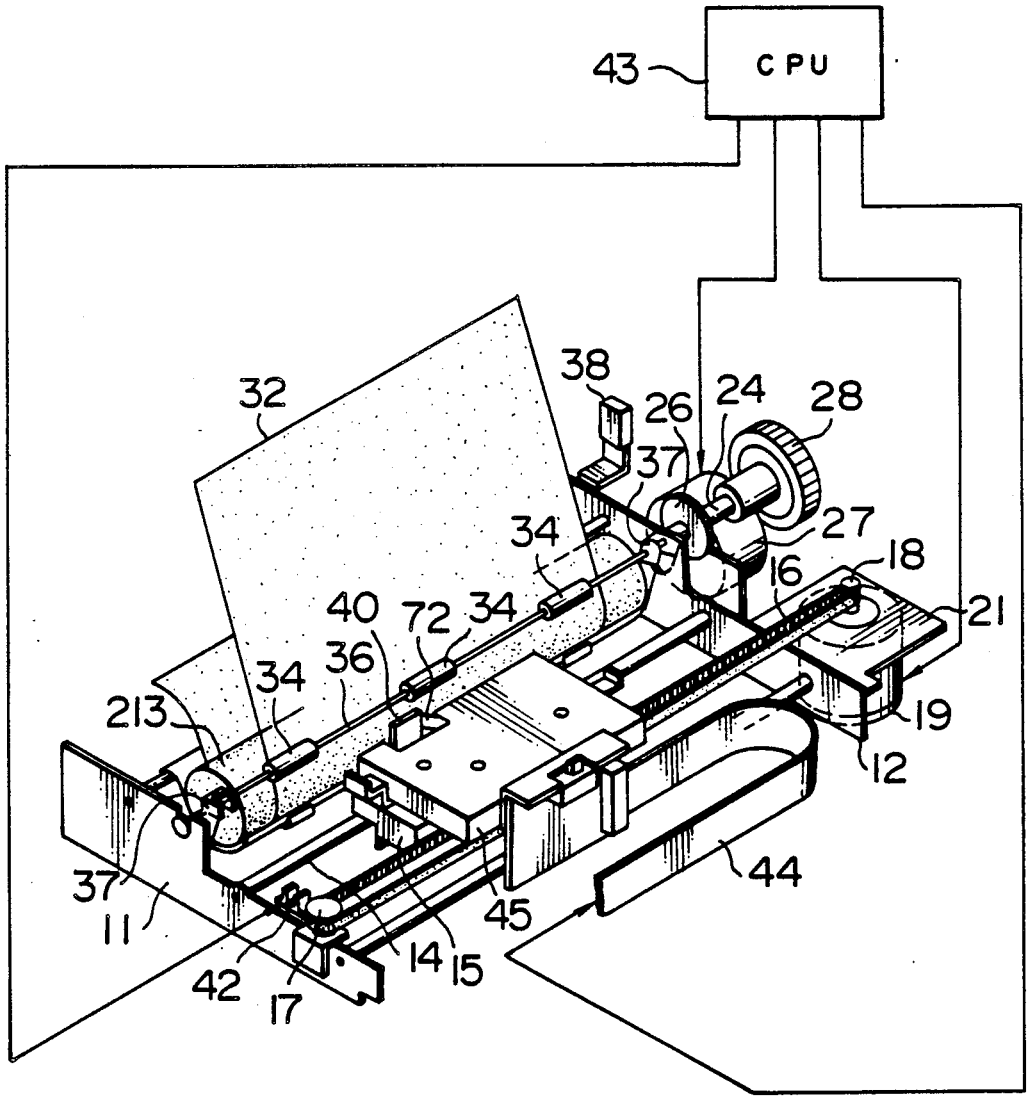
FIG. 14 is a view similar to FIG. 1 but showing a printer according to the second embodiment of the present invention.

The printer shown in FIG. 14 is substantially similar to the printer 10 shown in FIG. 1 except that a platen 213 has a circular crosssection.

Experiments have been conducted in order to determined the reason why a portion 52 of the inked ribbon 52 is shifted in the direction perpendicular to the longitudinal direction of the inked ribbon 52 with respect to the thermally sensitive head 40 during the operation of the printer, with the. The results of the experiments are described below with reference to FIGS. 15, 16.

Figure 15:
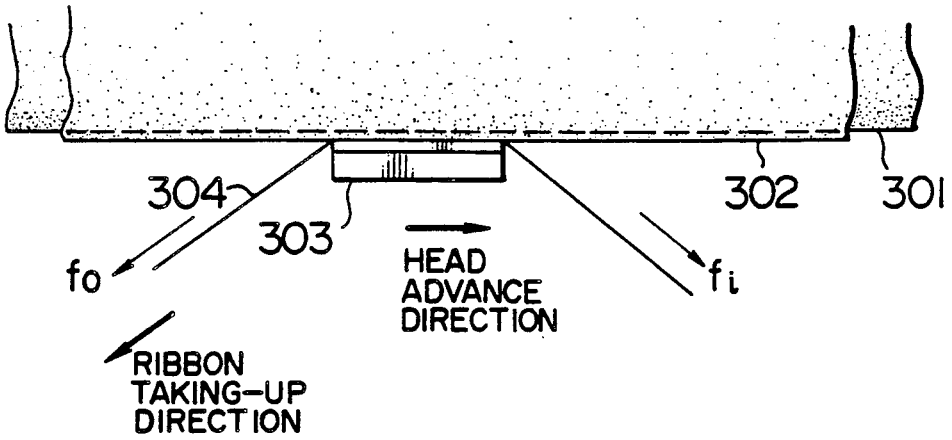
FIG. 15 PRIOR ART
FIG. 15 is a schematic fragmentary view showing the experiments carried out on the prior art printer by the inventors of the present application.
Figure 16:
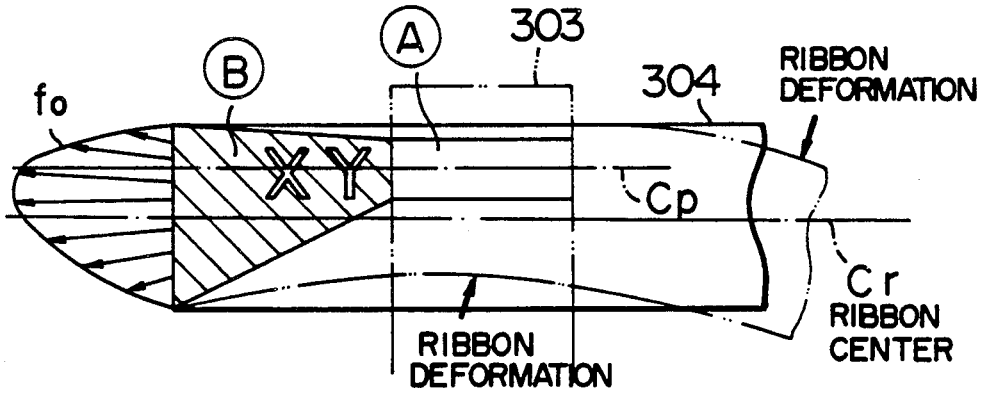
FIG. 16 PRIOR ART
FIG. 16 is a view showing the tension acting on the inked ribbon shown in FIG. 15.

FIG. 15 is a view showing the tension acting on an inked ribbon 304 as the inked ribbon 304 is fed while urged against a sheet 302 wound around a platen roller 301, with the printer being seen from the upper side. As shown in FIG. 15, a ribbon take-up tension fo acts in a direction opposite to the direction of advance of the head 303 while a back tension fi for stabilizing the feeding of the inked ribbon 304 acts in the reverse direction to the ribbon take-up tension fo. In general, the back tension fi is very small in comparison with the ribbon take-up tension fo. FIG. 16 is a view showing the phenomenon of shifting-down of the inked ribbon 304 having a center line designated as $C_r$ occurring when the printing is effected by using the upper track on the inked ribbon 304, wherein only the ribbon take-up tension fo is acting while the back tension fi is not acting. In the printing operation using the upper track on the inked ribbon 304, the area of the inked ribbon 304, pressed by the thermally sensitive head 303, is only the area Ⓐ in FIG. 16, and it is offset to the upper side with respect to the center Cr of the inked ribbon 304. As described previously, since the inked ribbon 304 is in general constructed by a very thin base film on the order of 4–8 micrometers, it has substantially no rigidity. Thus, only the component of the tension exists, while substantially no compression component exists. Therefore, the area of the inked ribbon 304 in which the tension is acting when the inked ribbon 304 take-up tension fo is applied becomes as shown in Ⓑ in FIG. 16 to render the same nonuniform in the upper and the lower side with respect to the center Cp of the pressed area Ⓐ resulting in the nonuniform distribution of the tension on the inked ribbon 304. As a result, the downwardly directed component of the tension becomes greater than the upwardly directed component of the tension, thereby resulting in the deformation of the inked ribbon 304 as shown by the two-dot-and-dash line. In other words, the inked ribbon 304 is shifted downwardly at the thermally sensitive head 303. For a similar reason, the inked ribbon 304 will be shifted upwardly when the lower track is used in a printing operation.

Figure 17:
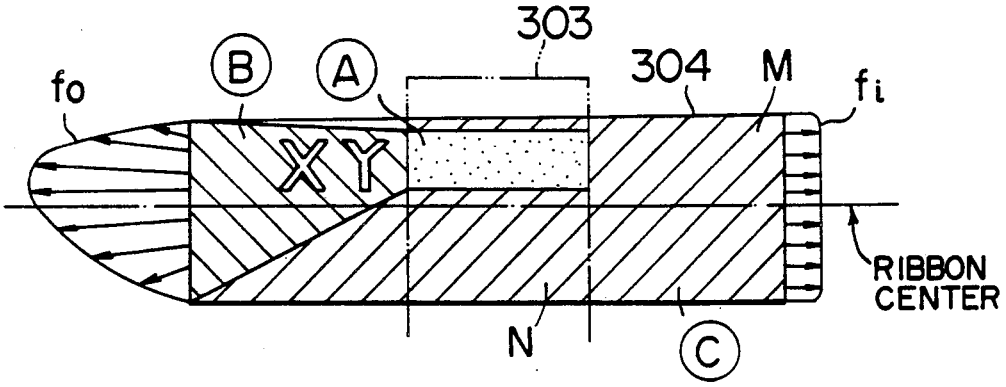
FIG. 17 is a view showing the distribution of the tension force acting on the ribbon in the combination of the printer and the ribbon cassette according to the present invention as shown in FIG. 14; the view being taken from the rear side of the thermally sensitive head.
Figure 18:
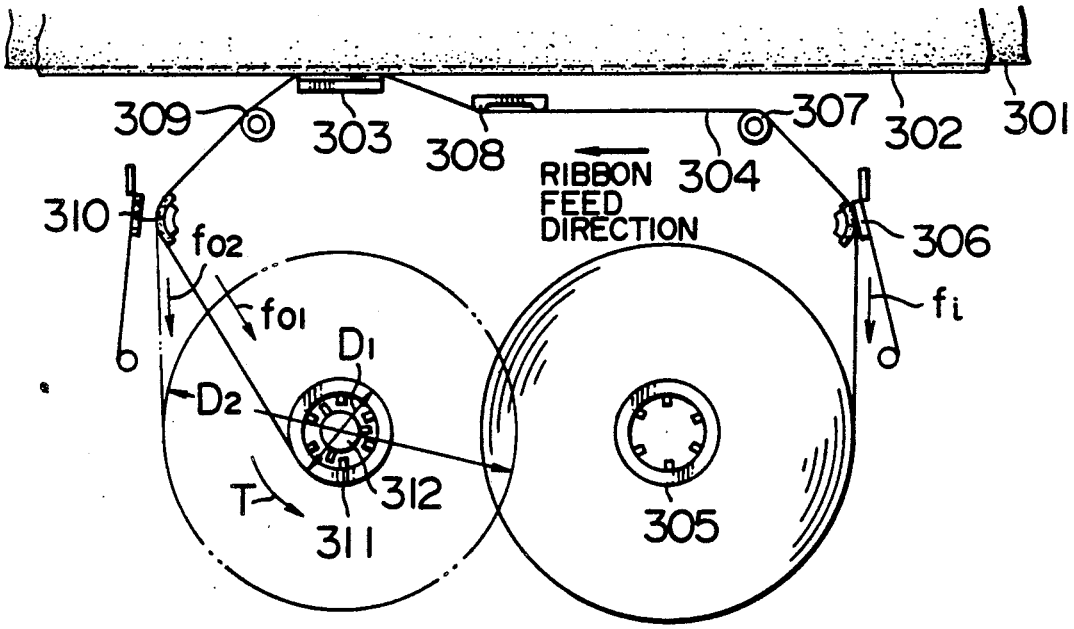
FIG. 18 PRIOR ART
FIG. 18 is a schematic view showing the path of feeding of the ribbon in the combination of a printer and a ribbon cassette of the prior art shown in FIG. 15.
Figure 19:
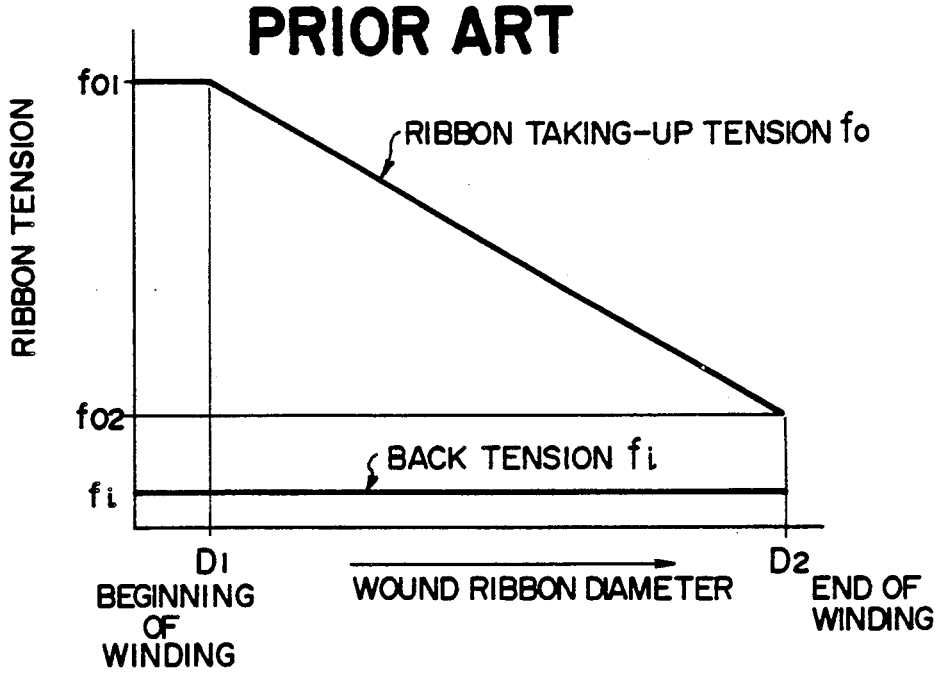
FIG. 19 PRIOR ART
FIG. 19 is a graphical illustration of the relationship between the tension acting on the ribbon and the diameter of the ribbon taken up onto the take-up core as the ribbon is moved along the path of feeding of the ribbon shown in FIG. 18.

The phenomenon of the shifting-up and -down of the inked ribbon 304 when no back tension fi is applied has been described. However, it has been found that the shifting-up and -down of the inked ribbon 304 can be prevented even though the position of the printing for the inked ribbon 304 is deviated toward the upper track or the lower track by setting the back tension fi to be a value greater than a predetermined value. The reason for the above will be described with reference to FIG. 17 which depicts the distribution of the tension in a ribbon 304 having upper and lower tracks M and N when the back tension fi additionally acts as shown in FIG. 16. As shown in FIG. 17 take-up tension fo only acts in the area (B), whereas the back tension fi acts in the area (C), whereby the tension acts on the entire area of the inked ribbon 304 . In other words, the back tension fi is effective to reduce the nonuniformity of the tension given to the inked ribbon 304. According to our experiments, the amount of the back tension fi required for preventing the shifting-up or -down of the inked ribbon 304 has a close relationship to the amount of the take up tension fo and, it is in intensive corelationship with the degree of deviation of the position of printing (A) with respect to the ribbon 304. That is, the greater the take-up tension fo and the greater the degree of deviation of the position of printing (A), the greater the back tension fi required. However, the amount of the back tension fi is limited by the condition that the inked ribbon 304 must be taken up until the last winding of the inked ribbon 304 is wound up. The reason for the above will be described with reference to FIGS. 18–20, inclusive, with FIG. 18 showing the feeding system of the ribbon 304 and the printer 10 as seen from the upper side thereof. The new inked ribbon 304 prior to the ink-transfer, which is wound around the ribbon supply core 305, is supplied to the front surface of the thermally sensitive head 303 through a back tension applying mechanism 306 for applying a constant back tension fi, a guide roller 307 and a post 308. At the front surface of the thermally sensitive head 303, the transfer of ink is carried out. The inked ribbon 304, after the transfer of ink, is further taken up onto the take-up core 311 through a guide roller 309 and a post 310. The take-up core 311 is given a constant rotary torque T by the engagement thereof with a take-up shaft 312 on a carriage such as, for example, the carriage 15 (FIG. 14), thereby effecting the taking-up of the inked ribbon 304. In this case, the problem arises that the take-up tension fo varies as the taking-up of the inked ribbon 304 proceeds because the diameter of the inked ribbon 304 wound around the take up core 311 increases. In other words, assuming that the diameter of the inked ribbon 304 at the beginning of the winding is D1 and the diameter of the inked ribbon 304 at the termination of the winding of the inked ribbon 304 is D2, the takeup tension fo on the inked ribbon 304 varies from the beginning of winding $f_{o1}=2T/D1$ to the termination of winding $f_{o2}=2T/D2$. FIG. 19 shows the variation in the ribbon take-up tension fo with respect to the diameter D of the wound inked ribbon 304, and the back tension fi. As is clear from this FIG. 19, the ribbon take-up tension fo is smaller as the diameter of the wound inked ribbon 304 increases, whereas, the back tension fi is kept constant. And, the requirement $f_{o2}>K\cdot fi$ must be satisfied where K is a coefficient of resistance to the feeding of the inked ribbon 304 in the cassette casing such as, for example, cassette casing 46 (FIG. 3), in order to make it possible to take up the entire inked ribbon 304 even when the diameter of the wound inked ribbon 304 becomes the maximum (D=D2) and the take-up 20 tension becomes the minimum ($fo=f_{o2}$). K is, in general, K=2–3 although it varies depending upon the cassette casing used. As described above, the back tension fi is limited by the requirements that the entire inked ribbon 304 must be taken up under the existence of the back tension fi.

Figure 20:
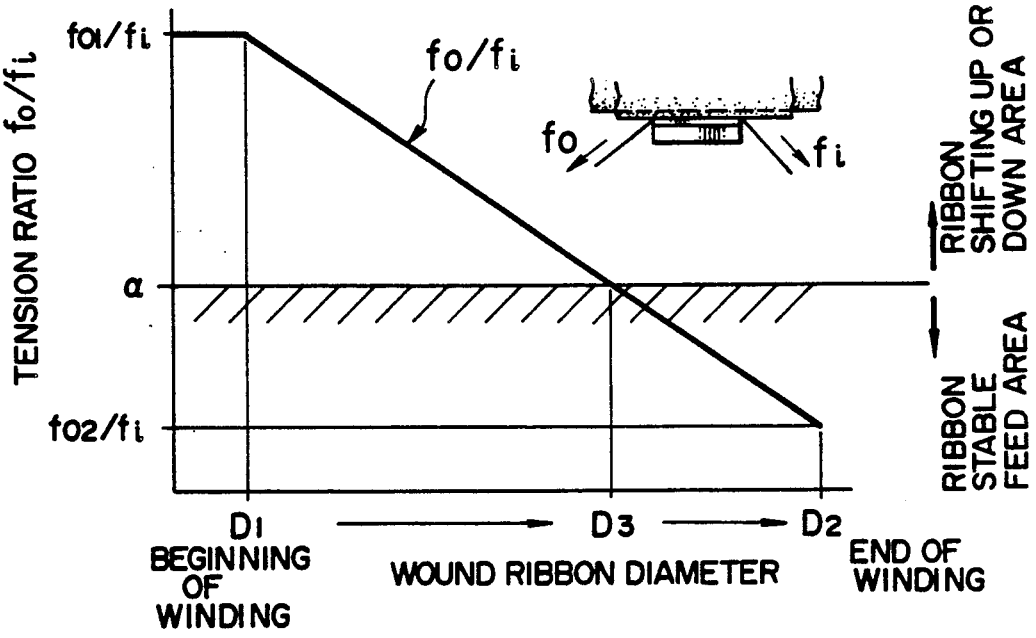
FIG. 20 is a graphical illustration similar to FIG. 19 but showing the relationship between the ratio of the tension and the diameter of the taken-up ribbon.

FIG. 20 graphically depicts in what range of the diameter of the wound inked ribbon 304 and the shifting-up or -down of the inked ribbon 304 occurs when the above take-up tension fo and the back tension fi are applied. As described previously, whether or not the shifting-up or -down of the inked ribbon 304 takes place is determined by the ratio between the take-up tension fo and the back tension fi, provided that the degree of the deviation of the printing position with respect to the inked ribbon 304 is the same. FIG. 20 shows the relationship between fo and fi shown in FIG. 19 replaced by the term fo/fi. As is clear from FIG. 20, if $fo/fi>\alpha$, shifting up or down of the inked ribbon 304 will take place, while shifting-up or -down of the inked ribbon 304 will not occur if $fo/fi<\alpha$. Here, $\alpha$ is a constant determined by the degree of deviation of the printing position with respect to the ribbon 304. That is, in the system of a constant back tension, shifting-up or -down of the inked ribbon 304 takes place in the range from the diameter D1 of wound inked ribbon 304 at the beginning of winding in which the take-up tension fo is great, to the diameter D3.

The second embodiment of the present invention is so constructed that the value of the back tension is variable correspondingly to the diameter of the wound inked ribbon 304 for the purposes of solving the above problem and it is directed to a construction preventing the shifting-up or down of the inked ribbon 304 wherein the ratio of taking up tension to the back tension is kept less than $\alpha$. This construction will be described below with reference to FIGS. 21 to 23, inclusive.

Figure 21:
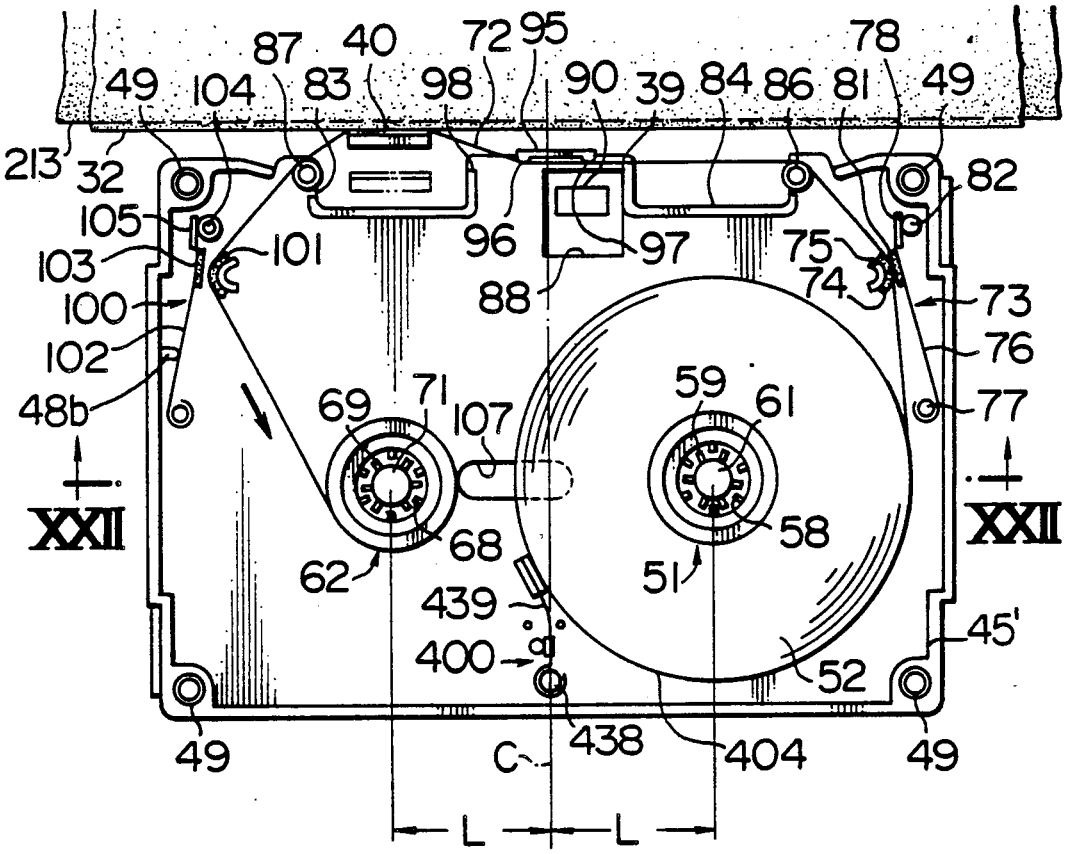
FIG. 21 is a plan view of the ribbon cassette loaded on the printer shown in FIG. 14 with the first casing half being removed.

In FIG. 21, a mechanism 400 is provided for applying a variable braking force, i.e., a variable back tension onto the outer periphery 404 of the inked ribbon 52 wound around the supply core 51. The variable back tension applying mechanism 400 will be described in detail below with reference to FIG. 23 which is a perspective view showing the detailed construction of the variable back tension applying mechanism 400. A post 438 for supporting a leaf spring 439 is provided integrally with the second casing half 48 at a position spaced an equal distance L from the center of the supply core 51 and the center of the take-up core 62. The leaf spring 439 is leftwardly and rightwardly swingably mounted on the leaf spring supporting post 438. A friction material 440 and a friction material 441 each made of a material such as felt are respectively adhesively secured to the front surface and the rear surface of one end 439*a* of the leaf spring 439. An engaging or camming member 443 is connected to the leaf spring 439 which is engageable with a push pin 442 provided on the carriage 15. When the ribbon cassette 45 is loaded on the carriage 15, the protruding pin 442 is inserted into the cassette casing 46 through a through hole 444 formed in the second casing half 48 so that the tip 442*a* of the push pin 442 engages with the camming portion 443*a* of the engaging member 443 thereby urging the leaf spring 439 in the direction toward the supply core 51. With this construction, the friction material 440, provided on the leaf spring 439, is urged against the outer periphery 404 of the inked ribbon 52 at the supply side thereby generating back tension $f_R$ against the feeding of the inked ribbon 52. When the cassette 45 is inverted, since the supply core 51 and the take up core 62 are reversely operated to act as a take-up core and a supply core, respectively, the push pin 442 (shown by the phantom line) at the inverted loading of the cassette 45 engages with a camming portion 443*b* of the engaging member 443 so that it pushes at all times only the outer periphery of the ribbon 52 at the supply side. The above described friction material 41 is provided for the purposes of applying a braking force onto the outer periphery of the inked ribbon 52 at the supply side upon the inverted loading of the cassette 45. Stopper pins 450, 451 are integrally formed in the second casing half 48 for limiting the respective positions of the leaf spring 439.

Figure 24:
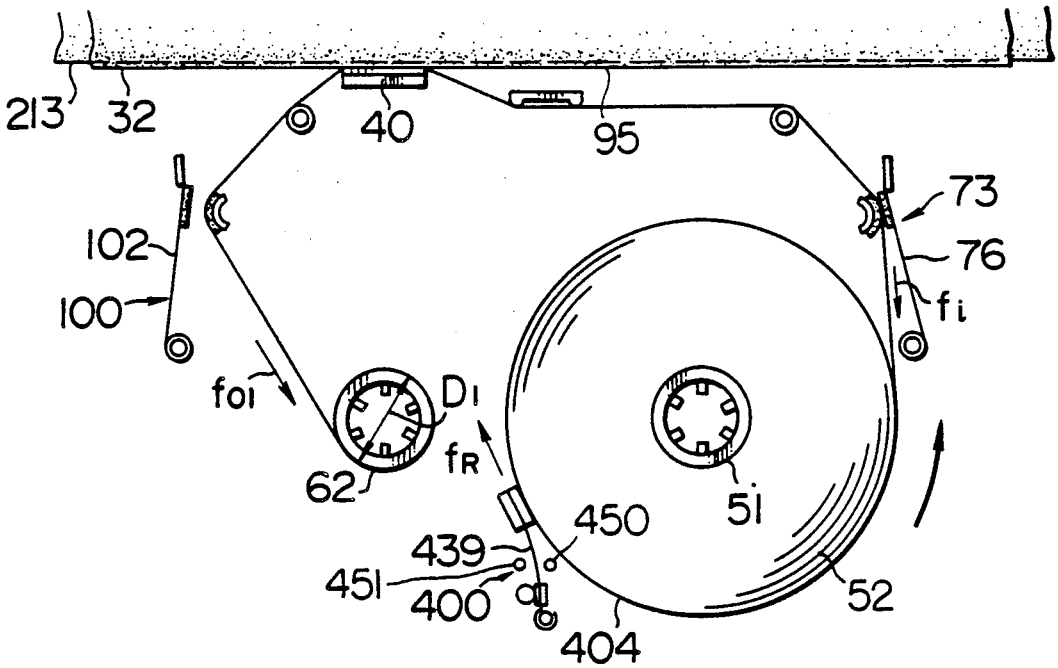
FIG. 24 is a schematic view showing the action of a plate spring in the variable back tension applying mechanism shown in FIG. 21 wherein the plate spring is in a position in which the amount of flexure thereof is at the maximum.
Figure 25:
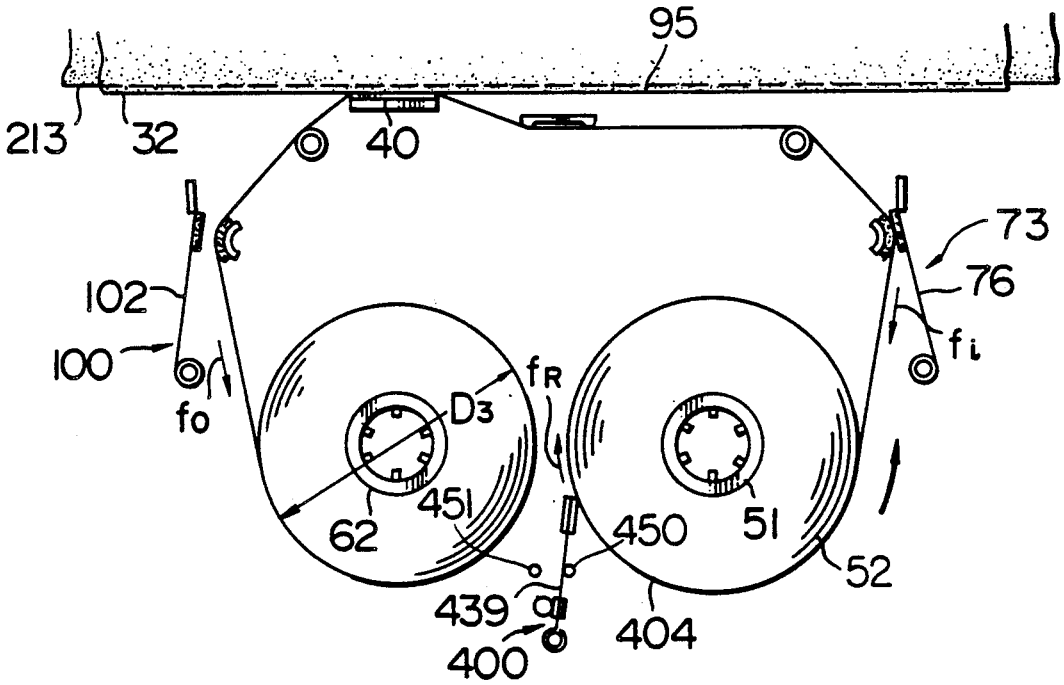
FIG. 25 is a schematic view similar to FIG. 24 but showing the leaf spring in a position in which the amount of flexure is reduced to the minimum.
Figure 26:
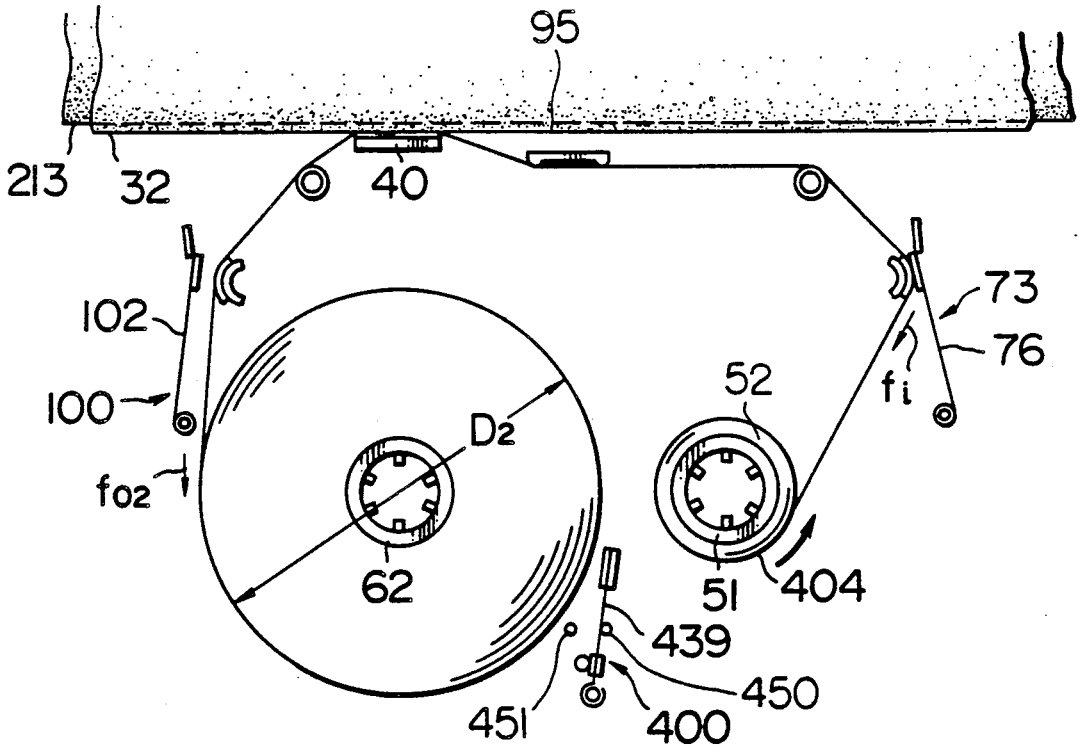
FIG. 26 is a schematic view similar to FIG. 25 but showing the leaf spring is in a position in which the amount of flexure is zero.

The operation of the leaf spring 439 for applying the variable braking force to the outer periphery 404 of the inked ribbon 52 at the supply side will be described with reference to FIGS. 24–26, inclusive. FIG. 24 shows the state of the inked ribbon 52 at the beginning of winding thereof, and FIG. 25 shows the midway point of taking up the inked ribbon 52, while FIG. 26 shows the state of the ribbon 52 at the end of winding. As shown in FIG. 24 the take-up tension fo becomes the maximum value $f_{o1}$ at the beginning of winding of the inked ribbon 52, but, since the diameter of the wound inked ribbon 52 at the supply side is the maximum, the amount of flexure (amount of deformation) of the leaf spring 439 applying the braking force, i.e., the back tension $f_R$ to the outer periphery 404 of the inked ribbon 52 also becomes the maximum so that a large back tension $f_R$ acts on the inked ribbon 52. As the taking-up of the inked ribbon 52 proceeds, the take-up tension $f_{01}$ gradually decreases, but, since the diameter of the inked ribbon 52 at the supply side also gradually decreases the flexure of the leaf spring 439 becomes zero at a certain point as shown in FIG. 25 so that there is no back tension $f_R$.

During the period from the time beginning at the state shown in FIG. 25 to the time ending at the end of winding of the inked ribbon 52 shown in FIG. 26, $f_R$ does not act but only fi acts, since the leaf spring 439 does not contact the outer periphery 404 of the inked ribbon 52 at the supply side.

Figure 27:
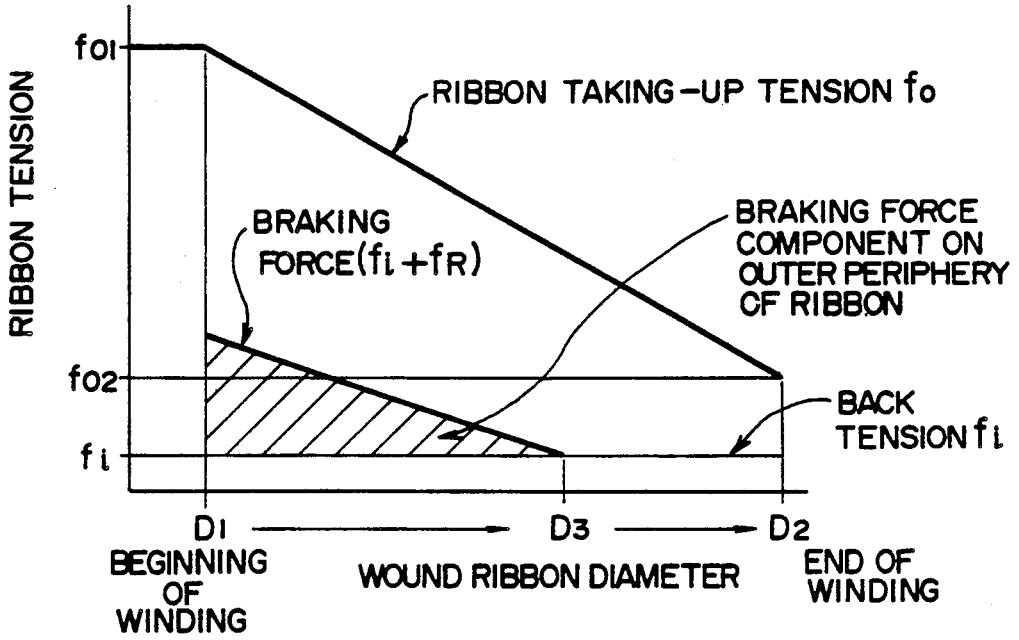
FIG. 27 is a graphical illustration of the relationship between the tension on the ribbon and the diameter of the taken-up ribbon and the relationship between the brake and the taking-up diameter of the ribbon as obtained in the combination of the printer and the ribbon cassette shown in FIG. 21.
Figure 28:
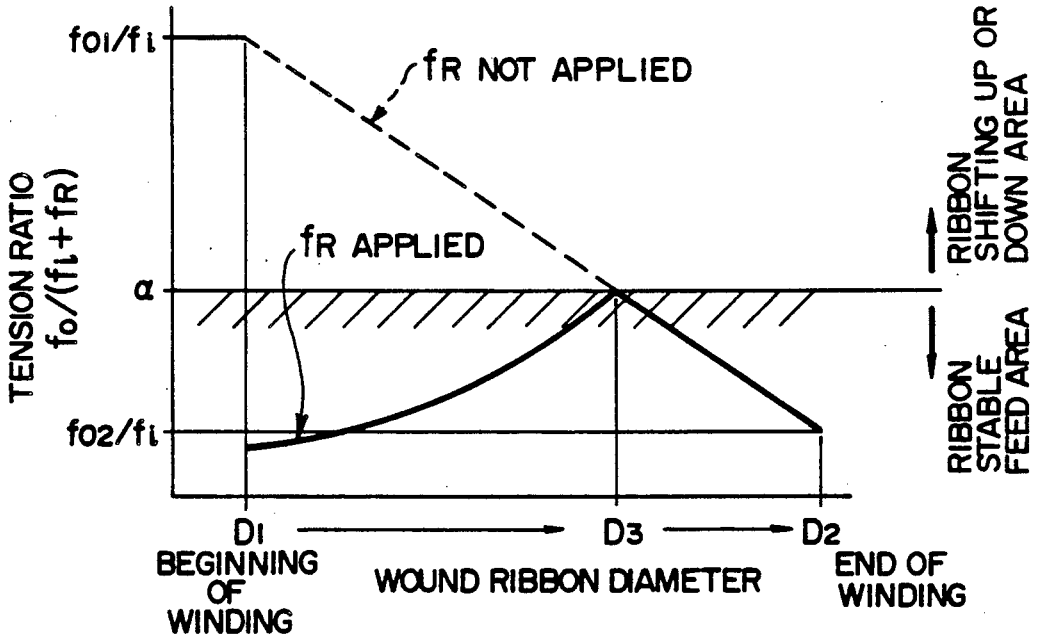
FIG. 28 is a graphical illustration similar to FIG. 27 but depicting the relationship between the ratio of the tension and the diameter of the taken-up ribbon.

The variation of the back tension $(fi+f_R)$ with respect to the diameter D of the wound inked ribbon 52 and the variation of the take-up tension fo on the inked ribbon 52 are summarized in FIG. 27. Here, the area shown by the hatching is the back tension component $f_R$ acting on the outer periphery 404 of the inked ribbon 52 at the supply side. As shown in FIG. 27, the back tension $(fi+f_R)$ becomes the maximum when the take up tension fo is the maximum value $f_{o1}$, and both forces decrease as the taking-up of the inked ribbon 52 proceeds. FIG. 28 shows the ratio of tension $fo/(fi+f_R)$ which is substituted for the tension shown in FIG. 27. As apparent from FIG. 28, the ratio of tension $fo/(fi+f_R)$ is held less than the constant $\alpha$ defining the limit of occurrence of the shifting-up or -down of the inked ribbon 52 over the entire range from the beginning at the diameter D1 upon beginning of winding of the inked ribbon 52 to ending at the diameter D2 upon the termination of winding of the ribbon 52.

In accordance with the present invention, the leaf spring 439 for applying the braking force to the outer periphery 404 of the inked ribbon 452 at the supply side is so shown as an example that only one such spring 439 is used therefor. However, it may be so constructed that a leaf spring 439 is provided at each of the outer periphery 404 of the inked ribbon 52 at the supply side and the outer periphery 404 of the inked ribbon 52 at the take-up side separately from each other in a manner similar to the back tension applying mechanisms 73 and 100, and the braking force of the leaf spring, similar to leaf spring 439 on the supply side in FIG. 21, at the take-up side is released by a push pin such as, for example, pin 442 in FIG. 23, on the carriage 15 at the time of loading of the cassette 45 on the carriage 15.

In accordance with the present invention, since the shifting-up or -down of the inked ribbon 52 at the thermally sensitive head can be prevented for the construction in which the printing position with respect to the inked ribbon 52 is offset from the center of the width of the inked ribbon 52 as in the case of the inked ribbon 52 having at least upper and lower tracks for printing the following advantageous effects are achieved.

Since printing is possible by using each of at least two tracks for printing provided on a single inked ribbon 52, the time period for exchanging the inked ribbon 52 is prolonged, thereby,permitting the operating cost of the printer 10 to be greatly reduced.

Furthermore, the construction of the body of the printer 10 may be the same as that of the prior art printer using a single track for printing on the ribbon 52. In other words, the user can utilize the existing printer by merely loading the ribbon cassette 45 thereby permitting the operating cost to be reduced.

Additionally, since the shifting-up or shifting-down of the ribbon 52 can be prevented, the allowance for the width of the ribbon 52 can be small, thereby permitting the size of the ribbon 52 which is the disposable article as well as the size of the ribbon cassette 45 to be compact.

Furthermore, since the regularly wound form of the ribbon 52 can be achieved, the load for taking up the ribbon 52 is reduced and it is possible to avoid any difficulties in the taking-up of the ribbon 52, while the take-up tension $F_o$ on the ribbon 52 is small, thereby permitting the shape and the size of the carriage 15 to be compact.

Figure 22:
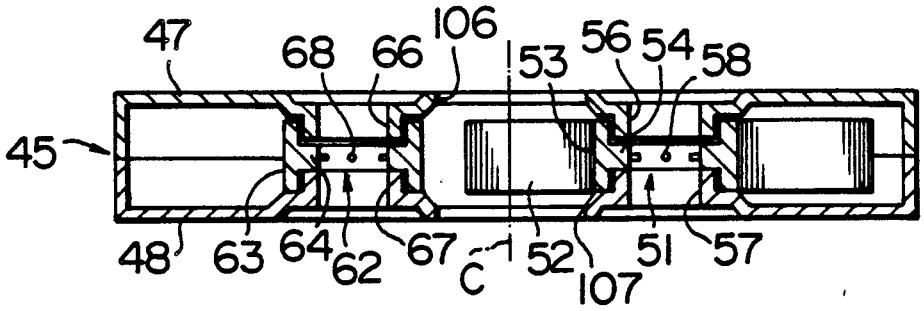
FIG. 22 is a cross sectional view taken along the line XXII—XXII in FIG. 21.
Figure 23:
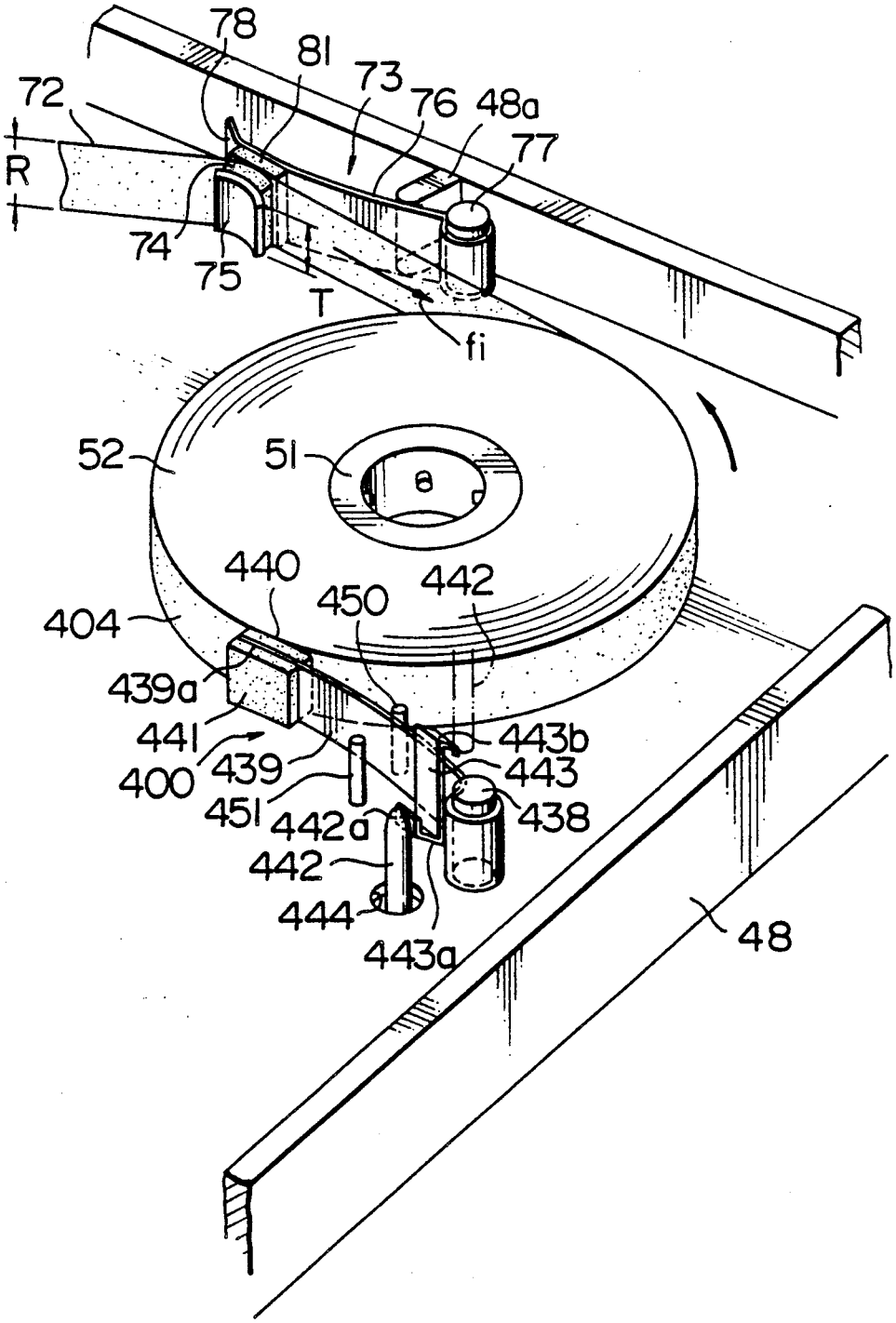
FIG. 23 is a perspective view on an enlarged scale, of a variable back tension applying mechanism shown in FIG. 21.

In the embodiment of FIGS. 21–23, the variable back tension applying mechanism 400 is arranged in the casing 46 of the ribbon cassette 45. However, a variable back tension applying mechanism 500 shown in FIG. 29 is provided on the carriage 15 and, therefore, each of the first casing half such as, for example, a casing half 47 shown in FIG. 22, and the second casing half 48 of the ribbon cassette 45 is formed with an opening 501 allowing the mechanism 500 to be introduced into the cassette 45 when the ribbon cassette 45 is loaded on the carriage 15.

Figure 29:
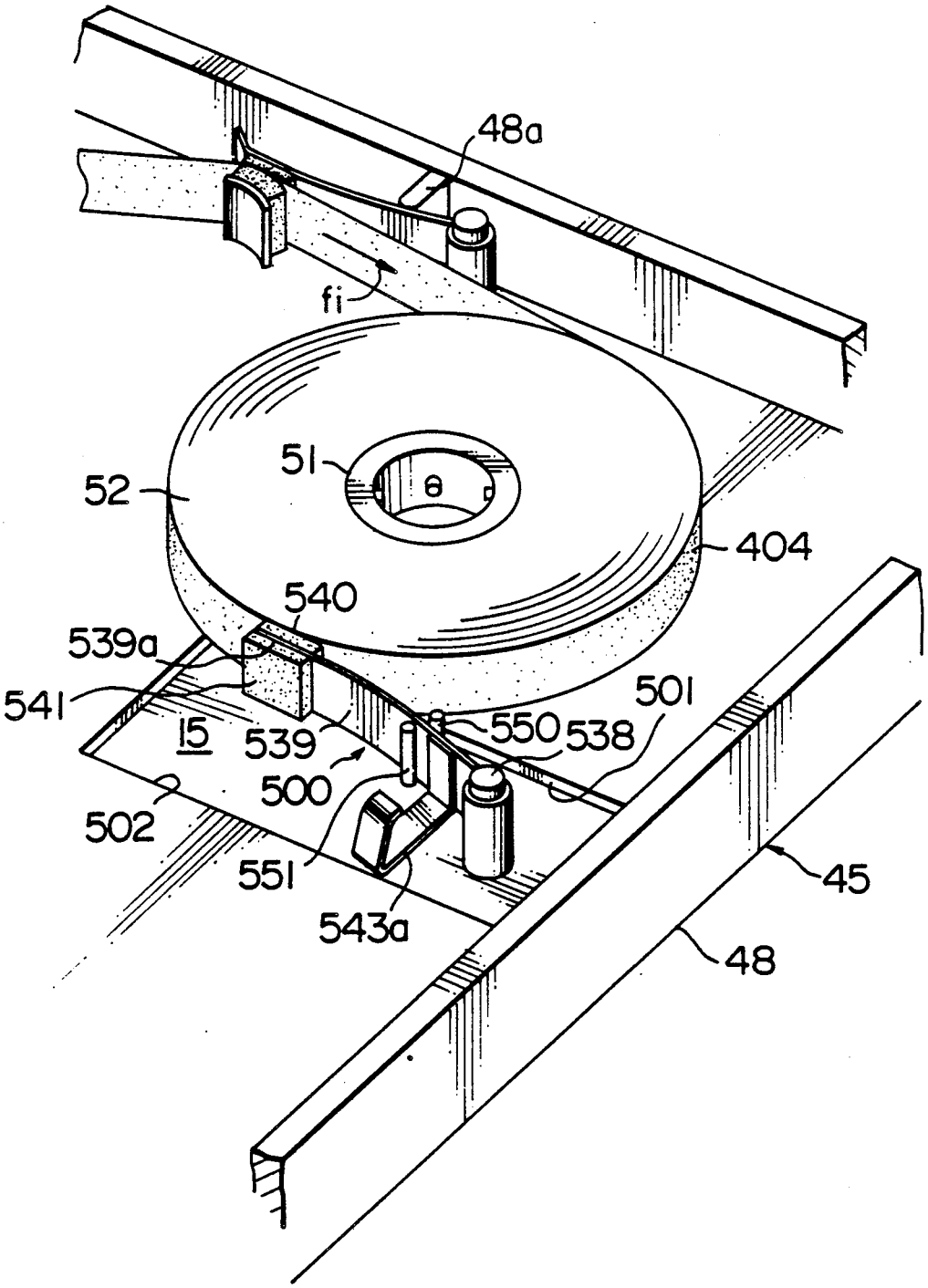
FIG. 29 is a perspective view, on an enlarged scale, of an alternative form of the variable back tension applying mechanism shown in FIG. 23, with the mechanism being mounted on the carriage of the printer.
Figure 30:
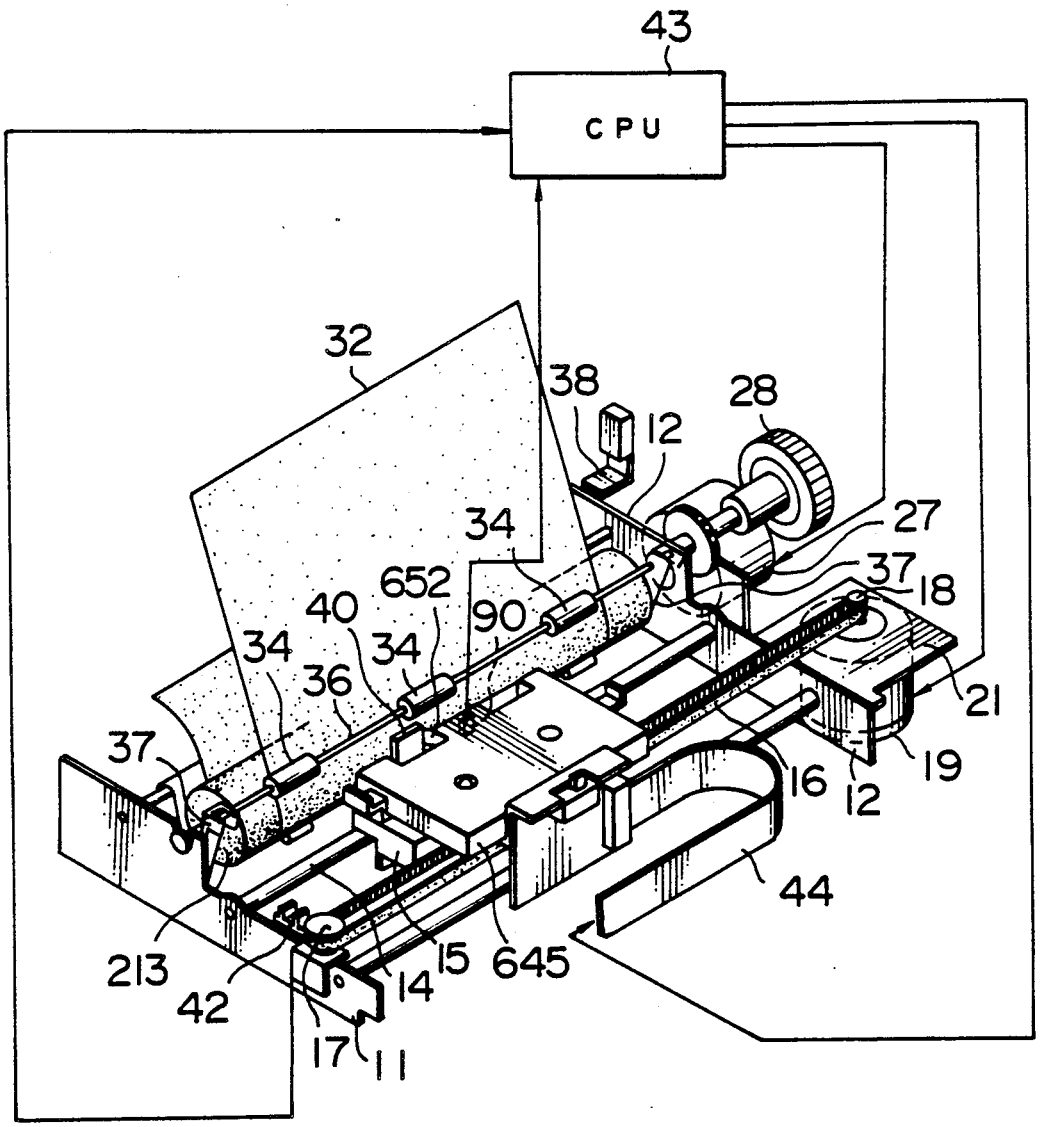
FIG. 30 is a perspective view, similar to FIG. 1, but illustrating a combination of the printer and a ribbon cassette according to a third embodiment of the present invention.

The variable back tension applying mechanism 500 shown in FIG. 29 itself is similar in construction to the mechanism 400 shown in FIGS. 21–23, and it has a leaf spring 539 having one end rotatably supported by a post 538 on the carriage 15, a pair of friction materials 540 and 541 each made of felt and adhesively attached to the respective surfaces of the other end 539*a* of the leaf spring 539, and a camming member 543*a* fixedly connected to the leaf spring 539. When the ribbon cassette 45 is loaded on the carriage 15, an edge 502 of the opening 501 formed in the second casing half 48 of the ribbon cassette 45 engages with the camming member 543*a* to resiliently urge the friction material 540 against the peripheral surface 404 of the inked ribbon 52 wound around the supply core 51. The movement and deformation of the leaf spring 539 are limited by a pair of pins 550 and 551. In the embodiment of FIGS. 31–35 a ribbon cassette 645, used in the printer of FIG. 30, with the ribbon cassette 645 being similar to the ribbon cassette 45 of FIGS. 2 and 3 except that the inked ribbon 52 therein has a width about a half of the width of the inked ribbon 52 of FIGS. 2 and 3, and a shielding member 600 is provided.

Figure 31:
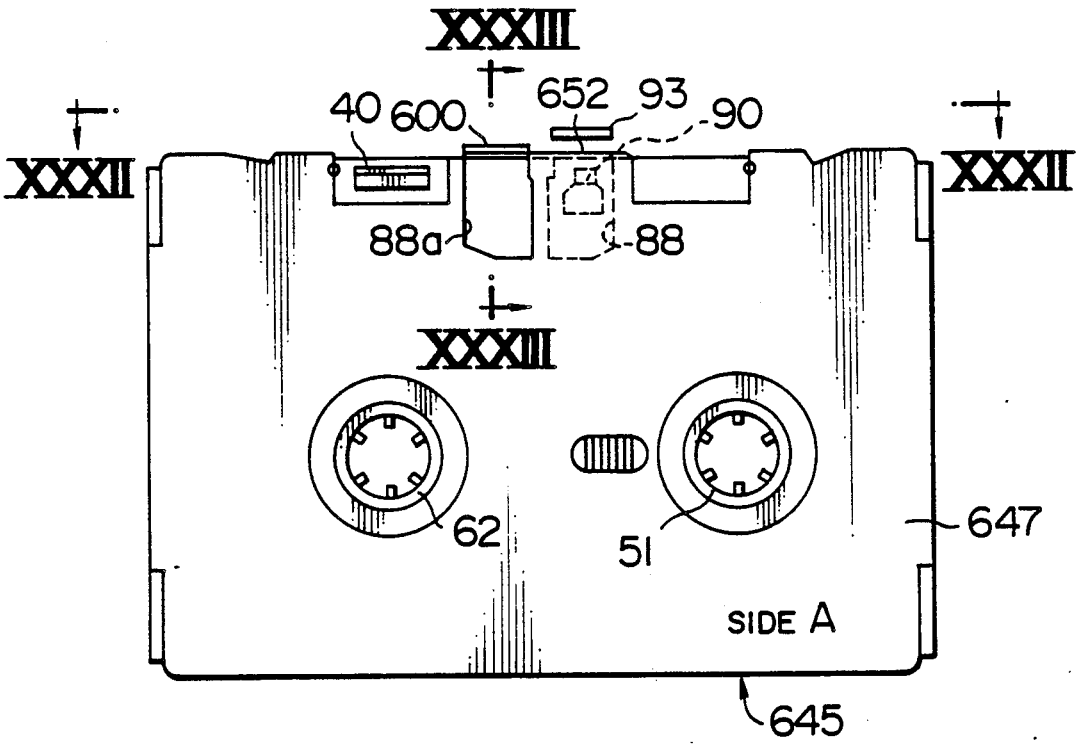
FIG. 31 is a plan view of the ribbon cassette loaded on the carriage of the printer shown in FIG. 30.
Figure 32:
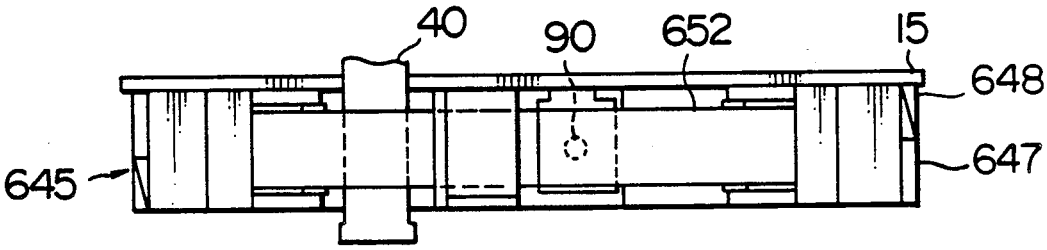
FIG. 32 is a view taken in the direction of the arrows XXXII—XXXII in FIG. 31.
Figure 33:
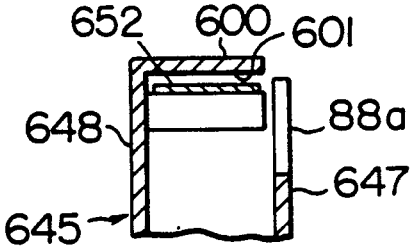
FIG. 33 is a fragmentary sectional view taken along the line XXXIII—XXXIII in FIG. 31.

As shown in FIGS. 31–33, the shielding member 600 is integrally formed on the second casing half 648 of the ribbon cassette 645 and is positioned adjacent the opening 88*a* formed in the first casing half 647. An inner surface 601 of the shielding member 600 forms the background having the same color as that of the inked ribbon 652. As is clear from FIG. 31, the shielding member 600 is associated only with the opening 88*a*, but is not associated with the opening 88 formed in the second casing half 648.

Figure 34:
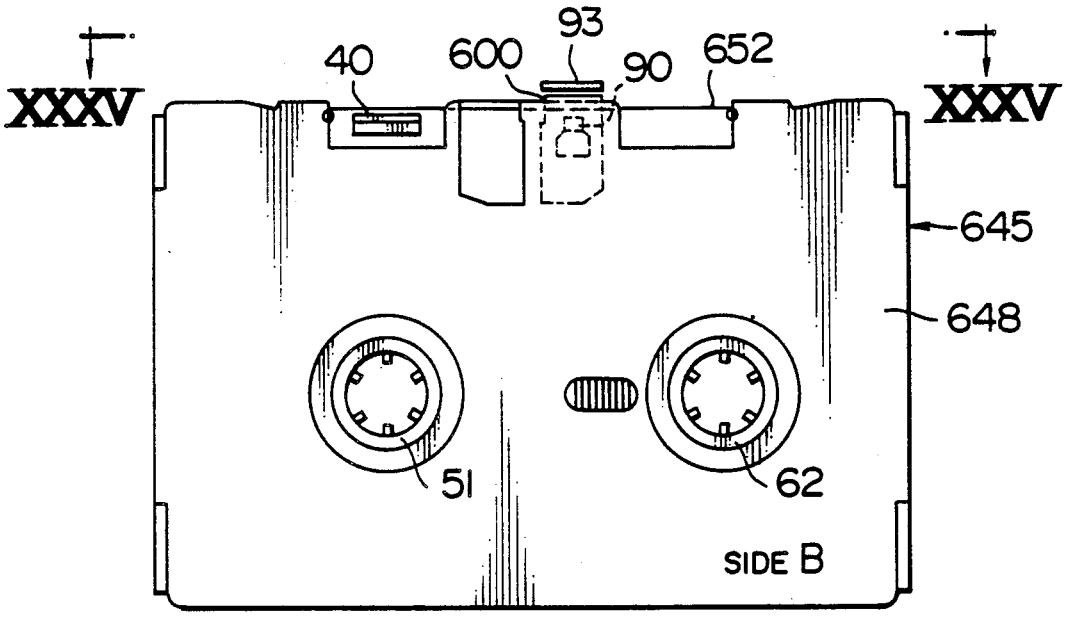
FIG. 34 is a plan view of the ribbon cassette shown in FIG. 31 which is inverted and again loaded in the carriage.

"Side A" is printed on the outer surface of the first casing half 647, while "Side B" is printed on the outer surface of the second casing half 648 as shown in FIG. 34.

As shown in FIGS. 31 and 32, the ribbon cassette 645 is loaded on the carriage 15 with the mark "Side A" facing upwardly. In the operation of the printer, the inked ribbon 652 is fed out from the supply core 51 and taken up onto the take-up core 62, while the thermally sensitive head 40 thermally transfers ink on the inked ribbon 652 to the sheet 32 on the platen 213. As a result of the transfer, the inked ribbon 652, taken up onto the take-up core 62, has areas from which ink has been removed. When the inked ribbon 652 wound around the feedout core 51 has been completely taken up onto the take-up core 62, the ribbon sensor 90 detects the terminal end of the inked ribbon 652 and send a signal to CPU 43 as previously described in connection with FIG. 5 to render the printer inoperative and to inform the operator of the fact that the inked ribbon 652 has been used up.

An inked ribbon cassette used in the prior art thermally transferring printer is discarded each time it has once been taken up for printing. However, the area of inked ribbon from which ink is actually removed during one printing operation is on the order of about 15% of the entire area of the inked ribbon and, therefore, this is very uneconomical. Although slight deficiency in printing characters might occur when the thus used inked ribbon is reused for printing, such an inked ribbon having been used once can be satisfactorily used in printing such documents as memorandums and the like other than important documents.

However, when an inked ribbon is reused a problem may arise in that the ribbon sensor 90 detects the portions having the ink removed therefrom to judge that no more inked ribbon is available inside the cassette 45 thereby interrupting the printing operation and rendering the printer inoperative.

Figure 35:
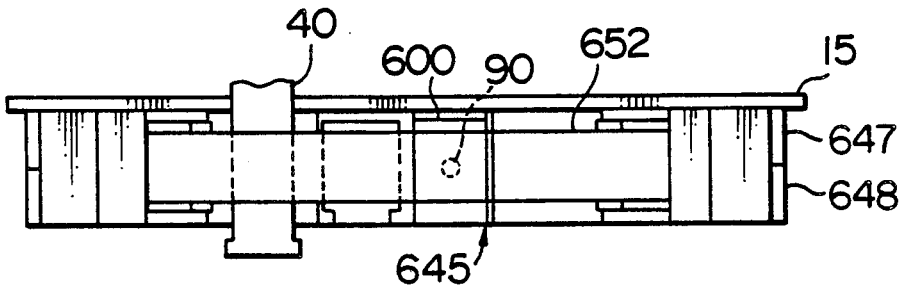
FIG. 35 is a view taken in the direction of the arrows XXXV—XXXV in FIG. 34.

The ribbon cassette 645 is unloaded from the carriage 15 after the inked ribbon 652 from the supply core 51 has been completely taken up onto the take-up core 62. Then, the ribbon cassette 645 is inverted so that the mark "Side B" faces upwardly as shown in FIGS. 34 and 35 and is loaded again on the carriage 15. At this time, the shielding member 600 having the inner surface 601 of the same color as that of the inked ribbon 652 is placed between the reflecting plate 93 and the inked ribbon 652. Although the inked ribbon 652 which is wound around the core 62 now acting as the supply core has areas from which ink has been removed by the previous printing operation, the light emitted from the light emitting diode 91 (FIG. 5) of the ribbon sensor 90 passes through the areas of the inked ribbon 652 without having ink and is absorbed in the inner surface 601 of the shielding member 600 so that no light is reflected from the shielding member 600. Thus, the phototransistor 92 (FIG. 5) of the ribbon sensor 90 does not receive any light thereby supplying to CPU 43 the first signal, i.e., a signal indicating that the inked ribbon 652 is present as previously described in connection with FIG. 5. Thus, CPU 43 supplies operating signals to the respective parts of the printer thereby permitting the thermally sensitive head 40 to thermally transfer ink remaining on the inked ribbon 652 to the sheet 32 on the platen 213.

With the above construction of the printer, the ribbon cassette 645 can be used twice in the reciprocating manner by merely inverting it for loading on the carriage 15, thereby achieving significant effectiveness in reducing the operating cost.

Since the mechanism of the thermally transferring printer may be the same as that of the prior art, unidirectional printing can be effected by merely inverting the ribbon cassette 645, and the effective length of the inked ribbon 652 for the printing can be made twice as long in comparison with the prior art system, thereby affording to the user remarkable effectiveness in reducing the operating cost.

In accordance with the present invention, the shielding member 600 is described as being provided on the ribbon cassette 645. However, it is possible to construct the printer in such a manner that the shielding member 600 is provided on the carriage 15 and the output signal of the inked ribbon sensor 90 is switched to a signal indicating the existence of the inked ribbon 652 regardless of the presence and nonpresence of ink on the inked ribbon 652.

Since the inked ribbon 652 already used once is reused to enable the reciprocal printing, a thermally transferring printer capable of lower operating cost can be provided, thereby affording the user maximum merits.

Although each of the above-described embodiments has been described and illustrated as having a thermally sensitive head 40 provided with a heat generating resistance element 41, the head may be of the type disclosed, for example, in Japanese Patent Laid-Open No. 57-129763.

What is claimed is:

1. In combination, a thermal transfer printer and a ribbon cassette having an inked ribbon for use with the printer, said ribbon being divided into at least first and second tracks extending longitudinally of the ribbon in parallel to each other, said printer comprising a platen, a carriage movable relative to said platen, and a printing head mounted on said carriage for movement therewith and constructed to urge the inked ribbon of said ribbon cassette against said platen, said printing head comprising a heat generating resistance element to affect thermal transfer of ink and said head being moveable between a first position remote from said platen and a second position where a portion of said inked ribbon is urged by said printing head against a sheet on said platen to thermally transfer ink within an area in one of said tracks of said portion of said inked ribbon to the sheet, said area on said portion of said inked ribbon having a width in the widthwise direction of the inked ribbon which is at most equal to one half of a width of said inked ribbon, wherein said platen has a surface thereof facing said printing head through said inked ribbon and the sheet when said printing head occupies said second position, said surface of said platen being substantially planar over an extent within which said printing head is moved and said planar surface of said platen has a width less than a width of said inked ribbon but greater than nH, where n is the number of said tracks of the ribbon and H is the width of the heat generating resistance element, wherein said ribbon cassette includes a supply core and a take-up core, means being provided for directly rotatingly driving said take-up core of said ribbon cassette to impart a taking-up tension to said inked ribbon; and means mounted on one of said carriage of said printer and said ribbon cassette and operative, in response to a change in diameter of the inked ribbon wound around said supply core, for imparting a variable back tension opposite to said taking-up tension, to said portion of said inked ribbon so as to constantly satisfy the relationship that the ratio of the taking-up tension to the back tension on said linked ribbon portion is less than $\alpha$, where $\alpha$=constant below which shifting-up or -down of the inked ribbon will not occur during printing, and said back tension being variable as to be reduced in accordance with the reduction in diameter of the inked ribbon wound around said supply core.

2. The combination as set forth in claim 1, wherein said means for imparting a variable back tension comprises elongated spring means having one end thereof fixed to one of said carriage of said printer and a casing of said ribbon cassette, and friction means mounted on the other end of said spring means and resiliently urged against the outermost turn of the inked ribbon wound around said supply core.

3. The combination as set forth in claim 2, wherein said means for imparting a variable back tension being located at substantially equal distances from a rotary axis of said supply core and a rotary axis of said take-up core; and actuator means mounted on the other of said carriage of said printer and said ribbon cassette for engaging said elongated spring means when said ribbon cassette is loaded on said carriage, to cause said elongated spring means to be deflected, to thereby urge said friction means against the outermost turn of the inked ribbon wound around said supply core with a predetermined urging force.

4. The combination as set forth in claim 2, wherein said means for imparting a variable back tension being located at substantially equal distances from a rotary axis of said supply core and a rotary axis of said take-up core; and a camming member connected to said spring means, said camming member being engaged by said printer when the ribbon cassette is loaded on the printer, to urge said friction means against the outermost turn of the inked ribbon wound around said supply core with a predetermined urging force.

5. A combination of a ribbon cassette and a printer for thermally transferring solid ink on a portion of an inked ribbon within said ribbon cassette to a sheet, said combination comprising:

said ribbon cassette including a rotatable supply core having wound therearound the inked ribbon and a rotatable take-up core for taking up the inked ribbon;

said printer comprising an elongated platen extending substantially perpendicularly to a direction of movement of the sheet upon new line starting, a carriage capable of being reciprocated longitudinally of said platen, said ribbon cassette being capable of being loaded on said carriage for movement therewith, said printing head being movable between a first position remote from said platen and a second position where a portion of said inked ribbon extending between said supply and take-up cores of said ribbon cassette is urged by said printing head against the sheet on said platen to thermally transfer the ink within an area of said inked ribbon portion to the sheet, said area on said inked ribbon portion having a width in the widthwise direction of said inked ribbon, the width of said area being at most equal to a half of a width of said inked ribbon, and means for directly rotatingly driving said take-up core of said ribbon cassette to impart a taking-up tension (fo) to said inked ribbon portion; and means mounted on either one of said carriage of said printer and said ribbon cassette and operative in response to a change in diameter of the inked ribbon wound around said supply core for imparting a variable back tension opposite to said taking-up tension, to said inked ribbon portion so as to constantly satisfy the following inequality, said back tension being variable so as to be reduced in accordance with the reduction in diameter of the inked ribbon wound around said supply core, such that the ratio of the taking-up tension (fo) to the back tension on said inked ribbon portion is less than $\alpha$ where $\alpha$=constant below which shifting-up or -down of the inked ribbon will not occur during printing.

6. A combination as set forth in claim 5, wherein said means for imparting a variable back tension imparts braking force to the outermost turn of the inked ribbon wound around said supply core.

7. A combination as set forth in claim 6, wherein said means for imparting a variable back tension comprises resilient means having an amount of deflection changing correspondingly to the change in diameter of the inked ribbon wound around said supply core.

8. A combination as set forth in claim 6, wherein said means for imparting a variable back tension comprises elongated spring means having one end thereof fixed to one of said carriage of said printer and a casing of said ribbon cassette, and friction means mounted on the other end of said spring means and resiliently urged against the outermost turn of the inked ribbon wound around said supply core.

9. A combination as set forth in claim 8, including:

said means for imparting a variable back tension being located at substantially equal distances from a rotary axis of said supply core and a rotary axis of said take-up core; and actuator means mounted on the other of said carriage of said printer and said ribbon cassette for engaging said elongated spring means when said ribbon cassette is loaded on said carriage, to cause said elongated spring means to be deflected, to thereby urge said friction means against the outermost turn of the inked ribbon wound around said supply core with a predetermined urging force.

10. A combination as set forth in claim 9, wherein said means for imparting a variable back tension is disposed within the casing of said ribbon cassette, the one end of aid elongated spring means is fixed to a wall of the casing, and said actuator means comprises a camming member connected to said spring means and a pin fixed to said carriage and protruding into said ribbon cassette, when the ribbon cassette is loaded on said carriage, to engage said camming member.

11. A combination as set forth in claim 10, wherein said elongated spring means comprises a leaf spring.

12. A combination as set forth in claim 11, wherein said friction means comprises felts respectively applied to opposite surfaces of the other end of said spring means.

13. A combination as set forth in claim 9, wherein said means for imparting a variable back tension is mounted on said carriage of said printer, the one end of said elongated spring means is fixed to said carriage, the casing of said ribbon cassette having an opening allowing said means, for imparting a variable tension to be introduced therethrough into said casing when said ribbon cassette is loaded on said carriage, and said actuator means comprises a camming member connected to said spring means and an edge of said opening engaging said camming member when said ribbon cassette is loaded on said carriage.

14. A combination as set forth in claim 13, wherein said elongated spring means comprises a leaf spring.

15. A combination as set forth in claim 14, wherein said friction means comprises felts respectively applied to opposite surfaces of the other end of said spring means.

16. A combination as set forth in claim 5, further comprising means for imparting an additional, constant back tension opposite to said taking-up tension, to said inked ribbon portion.

17. A combination as set forth in claim 16, wherein said means for imparting an additional, constant back tension is disposed within a casing of said ribbon cassette and comprises a first felt fixed to a wall of said casing, a leaf spring having one end thereof fixed to the wall of said casing, a second felt attached to the other end of said leaf spring for resiliently urging a portion of the inked ribbon extending between said supply and takeup cores, against said first felt.

18. A combination as set forth in claim 5, wherein said printing head has a heat-generating resistance element incorporated in an area of said printing head corresponding to said area on said inked ribbon portion.

* * * * *